US008469101B2

(12) United States Patent
Fowler et al.

(10) Patent No.: US 8,469,101 B2
(45) Date of Patent: Jun. 25, 2013

(54) METHOD AND APPARATUS FOR FLOW ASSURANCE MANAGEMENT IN SUBSEA SINGLE PRODUCTION FLOWLINE

(75) Inventors: Tracy A. Fowler, Sugar Land, TX (US); Jim R. Bennett, Houston, TX (US); Lionel M. Fontenette, Humble, TX (US); Richard F. Stoisits, Kingwood, TX (US); Virginia C. Witteveld, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 454 days.

(21) Appl. No.: 12/676,542

(22) PCT Filed: Aug. 15, 2008

(86) PCT No.: PCT/US2008/073354

§ 371 (c)(1),
(2), (4) Date: May 24, 2010

(87) PCT Pub. No.: WO2009/042307

PCT Pub. Date: Apr. 2, 2009

(65) Prior Publication Data

US 2010/0252260 A1 Oct. 7, 2010

Related U.S. Application Data

(60) Provisional application No. 60/995,161, filed on Sep. 25, 2007.

(51) Int. Cl.
*E21B 33/00* (2006.01)
*E21B 43/16* (2006.01)

(52) U.S. Cl.
USPC ..... 166/338; 166/339; 166/344; 166/345; 166/275

(58) Field of Classification Search
USPC ..... 166/311, 312, 369, 338, 339, 344, 166/345, 347, 352, 366, 367
See application file for complete search history.

(56) References Cited

U.S. PATENT DOCUMENTS 4,528,041 A 7/1985 Rickey et al.
4,574,830 A * 3/1986 Rickey et al. ..... 137/242

(Continued)

FOREIGN PATENT DOCUMENTS

GB 2196716 A 5/1988
WO WO 01/25593 A1 4/2001

(Continued)

OTHER PUBLICATIONS

Stoisits, R. F. et al., "Deep Water Single Production Line Tiebacks Achieving Operability Requirements While Minimizing Cost", 16th Annual Deep Water Offshore Technology Conference, Nov. 30-Dec. 2, 2004, pp. 1-12, New Orleans, LA.

*Primary Examiner* — Matthew Buck
*Assistant Examiner* — James Sayre
(74) *Attorney, Agent, or Firm* — ExxonMobil Upstream Research Company-Law Department

(57) ABSTRACT

Managing hydrates in a subsea includes a host production facility, a production cluster comprising one or more producers, a water injection cluster comprising one or more water injectors, a water injection line, and a single production line for directing production fluid from the one or more producers to the host production facility. The methods comprise placing a pig in the subsea production system, shutting in production from the producers, and injecting a displacement fluid into the subsea production system in order to displace the hydrate inhibitor and any remaining production fluids in the production flowline and to further move the pig through the production flowline. The method may also include further injecting displacement fluid into the subsea production system in order to displace the hydrate inhibitor and pig through the single production line and to the host production facility.

24 Claims, 13 Drawing Sheets

U.S. PATENT DOCUMENTS 5,490,562 A * 2/1996 Arnold ..... 166/267
5,536,893 A 7/1996 Gudmundsson
5,816,280 A 10/1998 Rojey et al.
5,842,816 A 12/1998 Cunningham
5,877,361 A 3/1999 Rojey et al.
5,927,901 A 7/1999 Graves
5,941,096 A 8/1999 Gudmundsson
6,015,929 A 1/2000 Rabeony et al.
6,022,421 A 2/2000 Bath et al.
6,025,302 A 2/2000 Pakulski
6,139,644 A 10/2000 Lima
6,152,993 A 11/2000 Klomp
6,214,091 B1 4/2001 Klomp
6,307,191 B1 10/2001 Waycuilis
6,336,238 B1 1/2002 Tarlton
6,350,928 B1 2/2002 Waycuilis et al.
6,379,612 B1 4/2002 Reizer et al.
6,536,461 B2 * 3/2003 Decker et al. ..... 137/268
6,539,778 B2 4/2003 Tucker et al.
6,596,089 B2 7/2003 Smith et al.
6,656,366 B1 12/2003 Fung et al.
6,703,534 B2 3/2004 Waycuilis et al.
6,752,214 B2 6/2004 Amin et al.
6,774,276 B1 8/2004 Lund et al.
6,782,950 B2 8/2004 Amin et al.
6,840,088 B2 1/2005 Tucker et al.
6,867,262 B1 3/2005 Angel et al.
6,880,640 B2 4/2005 Barratt et al.
7,008,466 B2 3/2006 Collins
7,032,658 B2 4/2006 Chitwood et al.
7,044,226 B2 5/2006 Stave
7,093,661 B2 8/2006 Olsen
7,261,810 B2 8/2007 Argo et al.
7,426,963 B2 9/2008 O'Neill
7,530,398 B2 5/2009 Balkanyi et al.
2003/0056954 A1 * 3/2003 Headworth ..... 166/302
2003/0145991 A1 * 8/2003 Olsen ..... 166/265
2004/0149445 A1 8/2004 Appleford et al.
2004/0176650 A1 9/2004 Lund et al.
2005/0137432 A1 6/2005 Matthews et al.
2005/0145388 A1 * 7/2005 Hopper ..... 166/357
2005/0205261 A1 9/2005 Andersen et al.
2005/0283927 A1 * 12/2005 Kinnari et al. ..... 15/3.5
2006/0106265 A1 5/2006 Rivers et al.
2006/0118308 A1 * 6/2006 Saucier ..... 166/344
2006/0144595 A1 7/2006 Milligan et al.
2006/0175062 A1 8/2006 Benson
2006/0175063 A1 * 8/2006 Balkanyi et al. ..... 166/357
2006/0218852 A1 10/2006 Graham
2006/0219412 A1 10/2006 Yater
2006/0272805 A1 12/2006 O'Malley et al.
2007/0003371 A1 1/2007 Yemington
2008/0016909 A1 1/2008 Lu
2008/0053659 A1 3/2008 Kinnari et al.
2008/0093081 A1 4/2008 Stoisits et al.
2009/0124520 A1 5/2009 Tohidi
2009/0230025 A1 9/2009 Argo et al.

FOREIGN PATENT DOCUMENTS

WO WO 02/25060 A1 3/2002
WO WO 2009/042319 A1 4/2009

* cited by examiner

METHOD AND APPARATUS FOR FLOW ASSURANCE MANAGEMENT IN SUBSEA SINGLE PRODUCTION FLOWLINE

CROSS REFERENCE TO RELATED APPLICATIONS

This application is the National Stage of International Application No. PCT/US2008/073354, filed Aug. 15, 2008, which claims the benefit of U.S. Provisional Application No. 60/995,161, filed Sep. 25, 2007.

FIELD OF THE INVENTION

Embodiments of the present invention generally relate to the field of subsea production operations. Embodiments of the present invention further pertain to methods for managing hydrate formation in subsea equipment such as a production line.

BACKGROUND OF THE INVENTION

More than two-thirds of the Earth's surface is covered by oceans. As the petroleum industry continues its search for hydrocarbons, it is finding that more and more of the untapped hydrocarbon reservoirs are located beneath the oceans. Such reservoirs are referred to as "offshore" reservoirs.

A typical system used to produce hydrocarbons from offshore reservoirs includes hydrocarbon-producing wells located on the ocean floor. The producing wells are sometimes referred to as "producers" or "subsea production wells." The produced hydrocarbons are transported from the producing wells to a host production facility which is located on the surface of the ocean or immediately on-shore.

The producing wells are in fluid communication with the host production facility via a system of pipes that transport the hydrocarbons from the subsea wells on the ocean floor to the host production facility. This system of pipes typically comprises a collection of jumpers, flowlines and risers. Jumpers are typically referred to in the industry as the portion of pipes that lie on the floor of the body of water. They connect the individual wellheads to a central manifold, or directly to a production flowline. The flowline also lies on the marine floor, and transports production fluids from the manifold to a riser. The riser refers to the portion of a production line that extends from the seabed, through the water column, and to the host production facility. In many instances, the top of the riser is supported by a floating buoy, which then connects to a flexible hose for delivering production fluids from the riser to the production facility.

The drilling and maintenance of remote offshore wells is expensive. In an effort to reduce drilling and maintenance expenses, remote offshore wells are oftentimes drilled in clusters. A grouping of wells in a clustered subsea arrangement is sometimes referred to as a "subsea well-site." A subsea well-site typically includes producing wells completed for production at one and oftentimes more "pay zones." In addition, a well-site will oftentimes include one or more injection wells to aid in maintaining in-situ pressure for water drive and gas expansion drive reservoirs.

The grouping of remote subsea wells facilitates the gathering of production fluids into a local production manifold. Fluids from the clustered wells are delivered to the manifold through the jumpers. From the manifold, production fluids may be delivered together to the host production facility through the flowline and the riser. For well-sites that are in deeper waters, the gathering facility is typically a floating production storage and offloading vessel, or "FPSO." The FPSO serves as a gathering and processing facility.

One challenge facing offshore production operations is flow assurance. During production, the produced fluids will typically comprise a mixture of crude oil, water, light hydrocarbon gases (such as methane), and other gases such as hydrogen sulfide and carbon dioxide. In some instances, solid materials such as sand may be mixed with the fluids. The solid materials entrained in the produced fluids may typically be deposited during "shut-ins," i.e. production stoppages, and require removal.

Of equal concern, changes in temperature, pressure and/or chemical composition along the pipes may cause the deposition of other materials such as methane hydrates, waxes or scales on the internal surface of the flowlines and risers. These deposits need to be periodically removed, as build-up of these materials can reduce line size and constrict flow.

Hydrates are crystals formed by water in contact with natural gases and associated liquids, in a ratio of 85 mole % water to 15% hydrocarbons. Hydrates can form when hydrocarbons and water are present at the right temperature and pressure, such as in wells, flow lines, or valves. The hydrocarbons become encaged in ice-like solids which can rapidly grow and agglomerate to sizes which can block flow lines. Hydrate formation most typically occurs in subsea production lines which are at relatively low temperatures and elevated pressures.

The low temperatures and high pressures of a deepwater environment cause hydrate formation as a function of gas-to-water composition. In a subsea pipeline, hydrate masses usually form at the hydrocarbon-water interface, and may accumulate as flow pushes them downstream. The resulting porous hydrate plugs have the unusual ability to transmit some degree of gas pressure, while acting as a flow hindrance to liquid. Both gas and liquid may sometimes be transmitted through the plug; however, lower viscosity and surface tension favors the flow of gas.

It is desirable to maintain flow assurance between cleanings by minimizing hydrate formation. One offshore method used for hydrate plug removal is the depressurization of the pipeline system. Traditionally, depressurization is most effective in the presence of lower water cuts. However, the depressurization process sometimes prevents normal production for several weeks. At higher water cuts, gas lift procedures may be required. Further, hydrates may quickly re-form when the well is placed back on line.

Most known deepwater subsea pipeline arrangements rely on two production lines for hydrate management. In the event of an unplanned shutdown, production fluids in the flowline and riser are commonly displaced with dehydrated dead crude oil using a pig. Displacement is completed before the production fluids (which are typically untreated or "uninhibited") cool down below the hydrate formation temperature. This prevents the creation of a hydrate blockage in the production lines. The pig is launched into one production line, is driven with the dehydrated dead crude out to the production manifold, and is driven back to the host facility through the second production line.

The two-production-line operation is feasible for large installations. However, for relatively small developments the cost of a second production line can be prohibitive. Therefore, an improved process of hydrate management is needed which does not, in certain embodiments, employ or rely upon two production lines. Further, a need exists for a hydrate management method that utilizes a water injection line and a single production line.

Further relevant information may be found in U.S. application Ser. No. 11/660,777, filed Feb. 21, 2007, and U.S. Provisional Patent Application No. 60/995,134 filed Sep. 25, 2007.

SUMMARY OF THE INVENTION

A method of managing hydrates in a subsea production system is provided. The subsea production system operates with a host production facility, a production cluster comprising one or more producers, a water injection cluster comprising one or more water injectors, a water injection line, and a single production line. The single production line directs fluids from the one or more producers to the host production facility. In one aspect, the method includes storing a pig in the subsea production system, shutting in production from the one or more producers, and injecting a hydrate inhibitor into the subsea production system. Hydrate inhibitor is injected in order to move the pig to the subsea production cluster, thereby at least partially displacing production fluids from the production cluster.

The method also includes injecting a displacement fluid into the subsea production system. The displacement fluid is injected in order to displace the hydrate inhibitor and any remaining production fluids into the single production line. This serves to further move the pig through the production line.

The method may also include further injecting displacement fluid into the subsea production system in order to displace the hydrate inhibitor and pig through the single production line and to the host production facility. Preferably, the displacement fluid is a dead displacement fluid such as crude oil, diesel, or a combination thereof. Alternatively, the displacement fluid may be additional hydrate inhibitor.

The subsea production system may include additional components. For example, the subsea production system preferably also comprises a control umbilical having a hydrate inhibitor line and a displacement fluid service line. In this arrangement, displacement fluid may be injected from the displacement fluid service line into the subsea production system.

The production cluster may include not only the one or more producers, but also a production manifold. Further, the production cluster may include jumpers for providing fluid communication between the production manifold and the one or more producers. The single production line preferably comprises a subsea production flowline and a production riser in fluid communication with the host production facility.

The subsea production system also preferably includes a water injection cluster. The water injection cluster comprises one or more water injectors, and a water injection manifold. In this arrangement, the water injection line may comprise a water injection riser and a subsea flowline for receiving injection water from the host production facility.

The subsea production system may also have a crossover manifold. A central pipeline may be placed in the crossover manifold to provide fluid communication between the water injection cluster and the production cluster.

In one aspect of the method, injecting a hydrate inhibitor into the subsea production system further comprises pumping the hydrate inhibitor from the hydrate inhibitor line into the production manifold and the jumpers. This serves to provide light touch operations before moving the pig through the production cluster.

In another aspect of the method, storing a pig in the subsea production system comprises injecting the pig into the water injection line, and then advancing the pig into a subsea storage location in the subsea production system using injection water. Alternatively, storing a pig in the subsea production system comprises placing the pig into the water injection cluster using a subsea pig launcher. In either instance, the method may further include storing the pig in the subsea storage location for a period of time, and launching the pig from the subsea storage location. Launching the pig may comprise advancing the pig from the subsea storage location, through the central pipeline, and to the production manifold.

After the pig has been launched from the subsea storage location, a new pig may be placed in the subsea storage location. Thus, in one aspect, the method further comprises launching a new pig from the host production facility. From there, the pig is moved through the water injection riser, through the water injection flowline, and to the subsea storage location. The pig is stored in the subsea storage location until a later time. The producers may be put back into production either before, during, or after the new pig is moved to the subsea storage location. Upon production, hydrocarbon fluids are produced from the one or more producers, through the production manifold, through the production flowline, through the production riser, and to the host production facility.

During a production line displacement procedure, it is optional to continue to inject water through the one or more injectors. In one aspect, water continues to be injected through the one or more injectors even while the pig is being moved to the subsea production cluster.

In one embodiment, the subsea production system further comprises a stand-alone manifold located near an outer end of the production flowline. This is in lieu of placing a crossover manifold between the injection manifold and the production manifold. The water injection line and the stand-alone manifold are interconnected by an extension of the water injection flowline and a smaller-bore water return line.

BRIEF DESCRIPTION OF THE DRAWINGS

So that the manner in which the features of the present invention can be better understood, certain flow charts, drawings, and graphs are appended hereto. It is to be noted, however, that the drawings illustrate only selected embodiments of the inventions and are therefore not to be considered limiting of scope, for the inventions may admit to other equally effective embodiments and applications.

FIG. 5 is another plan view of the production system of FIG. 3. Here, light-touch operations have begun in order to prepare the subsea production system for shut-in.

DETAILED DESCRIPTION OF CERTAIN EMBODIMENTS

Definitions

Figure 1:
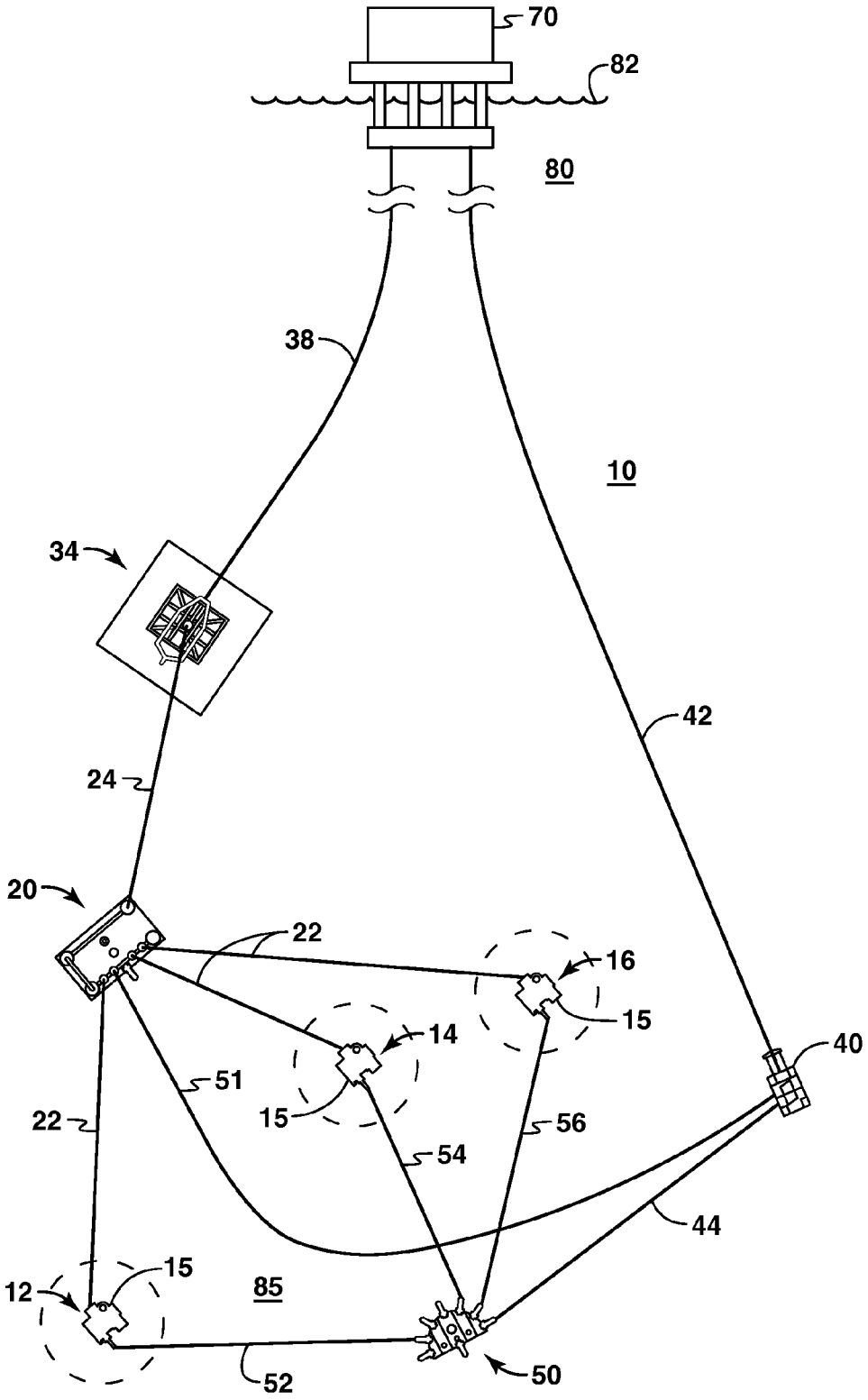
FIG. 1 Prior Art
FIG. 1 is a perspective view of a typical subsea production system utilizing a single production line and a utility umbilical line. The system is in production.

As used herein, the term "displacement fluid" refers to a fluid used to displace another fluid. Preferably, the displacement fluid has no hydrocarbon gases. Non-limiting examples include dead crude and diesel.

The term "umbilical" refers to any line that contains a collection of smaller lines, including at least one service line for delivering a working fluid. The "umbilical" may also be referred to as an umbilical line or a control umbilical. The working fluid may be a chemical treatment such as a hydrate inhibitor or a displacement fluid. The umbilical will typically include additional lines, such as hydraulic power lines and electrical power cables.

The term "service line" refers to any tubing within an umbilical. The service line is sometimes referred to as an umbilical service line, or USL. One example of a service line is an injection tubing used to inject a chemical.

The term "low dosage hydrate inhibitor," or "LDHI," refers to both anti-agglomerates and kinetic hydrate inhibitors. It is intended to encompass any non-thermodynamic hydrate inhibitor.

The term "production facility" means any facility for receiving produced hydrocarbons. The production facility may be a ship-shaped vessel located over a subsea well site, an FPSO vessel (floating production, storage and offloading vessel) located over or near a subsea well site, a near-shore separation facility, or an onshore separation facility. Synonymous terms include "host production facility" or "gathering facility." In some embodiments, the term "production facility" may refer to more than one facility including at least one for injecting water and another for receiving production fluids.

The terms "tieback," "tieback line," and "riser" and "production line" are used interchangeably herein, and are intended to be synonymous. These terms mean any tubular structure or collection of lines for transporting produced hydrocarbons to a production facility. A production line may include, for example, a production flowline, a riser, spools, and topside hoses.

The term "production line" means a riser and any other pipeline used to transport production fluids to a production facility. The production line may include, for example, a subsea production line and a flexible jumper.

"Subsea production system" means an assembly of production equipment placed in a marine body. The marine body may be an ocean environment, or it may be, for example, a fresh water lake. Similarly, "subsea" includes both an ocean body and a deepwater lake.

"Subsea equipment" means any item of equipment placed proximate the bottom of a marine body as part of a subsea production system. Such equipment may include production equipment and water injection equipment.

"Subsea well" means a well that has a tree proximate the marine body bottom, such as an ocean bottom. "Subsea tree," in turn, means any collection of valves disposed over a wellhead in a water body.

"Manifold" means any item of subsea equipment that gathers produced fluids from one or more subsea trees, and delivers those fluids to a production line, either directly or through a jumper line.

"Inhibited" means that produced fluids have been mixed with or otherwise been exposed to a chemical inhibitor for inhibiting formation of gas hydrates including natural gas hydrates. Conversely, "uninhibited" means that produced fluids have not been mixed with or otherwise been exposed to a chemical inhibitor for inhibiting formation of gas hydrates.

Description of Selected Specific Embodiments

FIG. 1 provides a perspective view of a typical subsea production system 10 which may be used to produce from a subterranean offshore reservoir. The system 10 utilizes a single production flowline, including a riser 38. Oil, gas and, typically, water, referred to as production fluids, are produced through the production riser 38. In the illustrative system 10, the production riser 38 is an 8-inch insulated production line. However, other sizes may be used. Thermal insulation is provided for the production riser 38 to maintain warmer temperatures for the production fluids and to inhibit hydrate formation during production. Preferably, the production line protects against hydrate formation during a minimum of 20 hours of cool-down time during shut-in conditions.

The production system 10 includes one or more subsea wells. In this arrangement, three wells 12, 14 and 16 are shown. The wells 12, 14, 16 may include at least one injection well and at least one production well. In the illustrative system 10, wells 12, 14, 16 are all producers, thereby forming a production cluster.

Each of the wells 12, 14, 16 has a subsea tree 15 on a marine floor 85. The trees 15 deliver production fluids to jumpers 22, or short flowlines. The jumpers 22, in turn, deliver production fluids from the production wells 12, 14, 16 to a manifold 20. The manifold 20 is an item of subsea equipment comprised of valves and piping in order to collect and distribute fluid.

Fluids produced from the production wells 12, 14, 16 are usually commingled at the manifold 20, and exported from the well-site through a subsea production jumper 24 and the riser and flowline 38.

The production riser 38 ties back to a production facility 70. The production facility, also referred to as a "host facility" or a "gathering facility," is any facility where production fluids are collected. The production facility may, for example, be a ship-shaped vessel capable of self-propulsion in the ocean. The production facility may alternatively be fixed to land and reside near shore or immediately on-shore. However, in the illustrative system 10, the production facility 70 is a floating production, storage and offloading vessel (FPSO) moored in the ocean. The FPSO 70 is shown positioned in a marine body 80, such as an ocean, having a surface 82 and a marine floor 85. In one aspect, the FPSO 70 is 3 to 15 kilometers from the manifold 20.

In the arrangement of FIG. 1, a production sled 34 is used. The optional production sled 34 connects the jumper 24 with the production flowline and riser 38. A flexible hose (not seen in FIG. 1) may be used to facilitate the communication of fluid between the riser 38 and the FPSO 70.

The subsea production system 10 also includes a utility umbilical 42. The utility umbilical 42 represents an integrated electrical/hydraulic control line. Utility umbilical line 42 typically includes conductive wires for providing power to subsea equipment. A control line within the umbilical 42 may carry hydraulic fluid to the subsea distribution unit (SDU) 50 used for controlling items of subsea equipment such as a subsea manifold 20, and trees 15. Such control lines allow for the actuation of valves, chokes, downhole safety valves, and other subsea components from the surface. Utility umbilical 42 also includes a chemical injection tubing or service line which transmits chemical inhibitors to the ocean floor, and then to equipment of the subsea production system 10. The inhibitors are designed and provided in order to ensure that flow from the wells is not affected by the formation of solids in the flow stream such as hydrates, waxes and scale. Thus, the umbilical 42 will typically contain a number of lines bundled together to provide electrical power, control, hydraulic power, fiber optics communication, chemical transportation, or other functionalities.

The utility umbilical 42 connects subsea to an umbilical termination assembly ("UTA") 40. From the umbilical termination assembly 40, flying lead 44 is provided, and connects to a subsea distribution unit ("SDU") 50. From the SDU 50, flying leads 52, 54, 56 connect to the individual wells 12, 14, 16, respectively.

In addition to these lines, a separate umbilical line 51 may be directed from the UTA 40 directly to the manifold 20. A displacement fluid injection service line (not seen in FIG. 1) is placed in both of service umbilical lines 42 and 51. The service line is sized for the pumping of a displacement fluid. During shut-in, and during a hydrate management operation, the displacement fluid is pumped through the displacement fluid injection service line, through the manifold 20, and into the production riser 38 in order to displace produced hydrocarbon fluids before hydrate formation begins.

The displacing fluids may be dehydrated and degassed crude oil. Alternatively, the displacing fluids may be diesel. In either instance, an additional option is to inject a traditional chemical inhibitor such as methanol, glycol or MEG before the displacement fluid.

It is understood that the architecture of system 10 shown in FIG. 1 is illustrative. Other features may be employed for producing hydrocarbons from a subsea reservoir and for inhibiting the formation of hydrates. Indeed, in the present system shown at 300 in various figures that follow, a number of additional items of equipment are described.

Figure 2A:
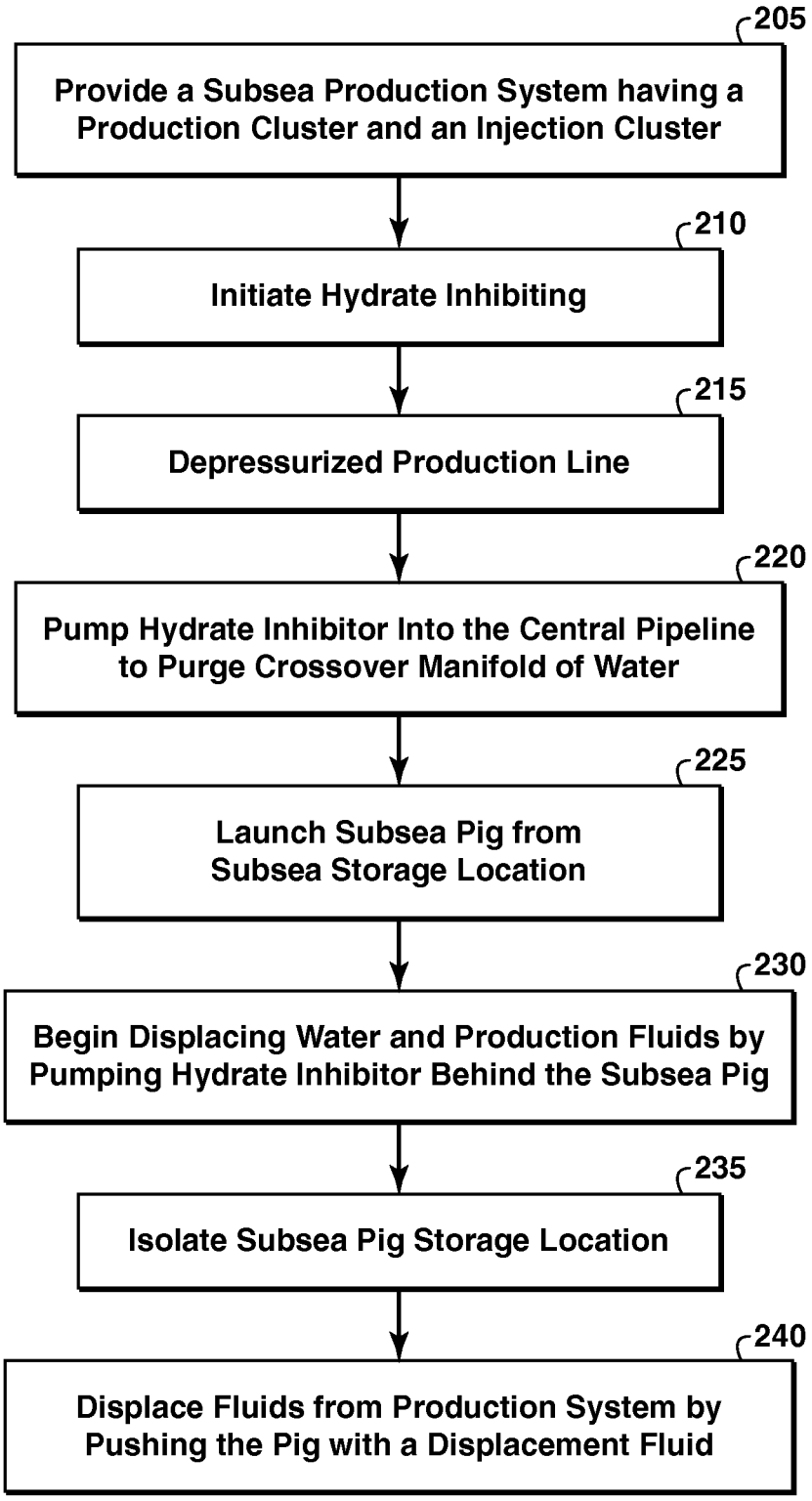
FIGS. 2A and 2B present a flowchart demonstrating steps for performing the hydrate management process of the present invention, in one embodiment.
Figure 2B:
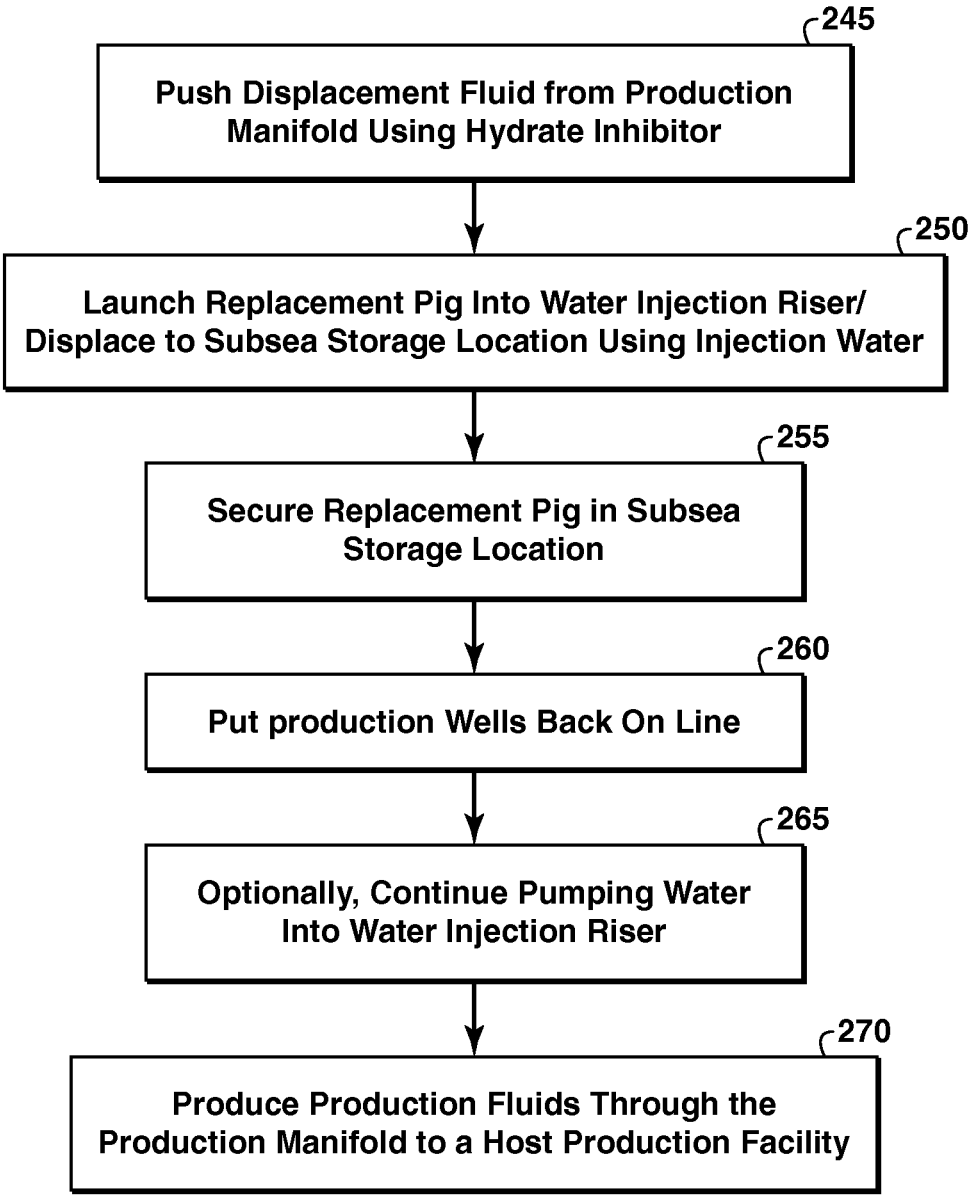

FIGS. 2A and 2B together present a flowchart demonstrating steps for performing a hydrate management process 200 of the present invention, in one embodiment. The method 200 first includes the step of providing a subsea production system. This step is illustrated at Box 205. In operation, the subsea production system generally includes a production cluster and an injection cluster.

Figure 3:
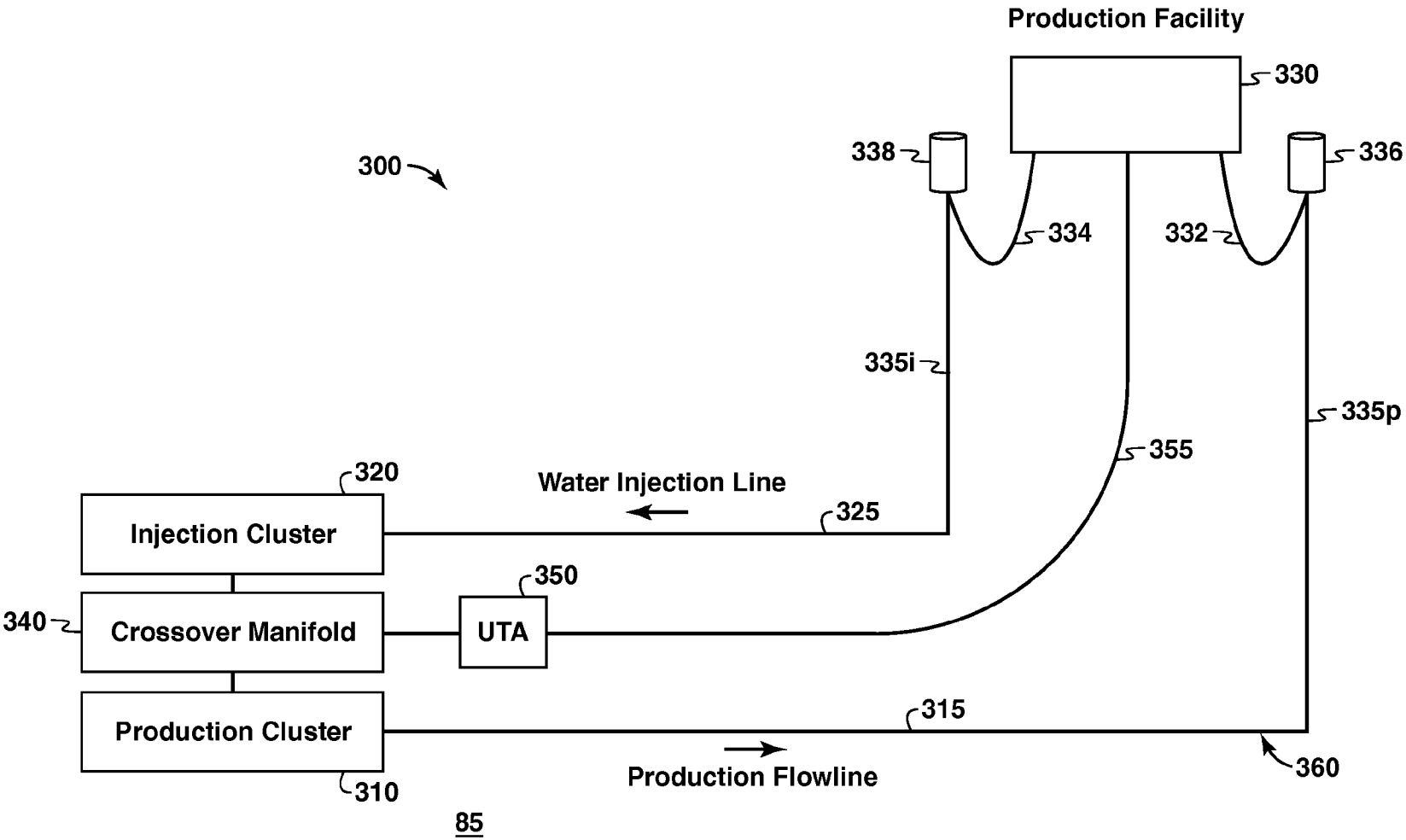
FIG. 3 is a side view of a production line, a water injection line and a utility umbilical line. The view is somewhat schematic, and shows a subsea production system in production and a water injection system injecting water.

FIG. 3 presents a schematic view of a subsea production system 300 as may generally be used in practicing the method 200. It can be seen in the arrangement of FIG. 3 that the production system 300 includes a production cluster 310 and an injection cluster 320. The production cluster 310 generally comprises one or more production wells (or "producers"), and a production manifold. Similarly, the injection cluster 320 generally includes one or more subsea injection wells (or "injectors") and an injection manifold. The production cluster 310 and the injection cluster 320 are illustrated in greater detail in FIG. 4, discussed below.

The subsea production system 300 also includes a production facility 330. Typically, the production facility 330 will be either (1) a ship-shaped floating production, storage and offloading vessel (or "FPSO"), or (2) a semi-submersible vessel, (3) a tension-leg platform vessel, or (4) a deep-draft caisson vessel. However, the present methods are not limited by the nature or configuration of the host production facility 330. Indeed, the production facility 330 may be a near-shore or on-shore facility. Further, the production facility 330 may include multiple facilities, such as one facility for injecting water and another facility for receiving produced fluids.

The production cluster 310 is placed in fluid communication with the production facility 330 by a production line. The production line generally comprises a production flowline 315 along the marine floor, and a production riser 335*p*. Similarly, the injection cluster 320 is placed in fluid communication with the production facility by means of a water injection line. The water injection line generally comprises an injection flowline 325 along the marine floor, and a water injection riser 335*i*.

The production flowline 315 is preferably insulated. More specifically, the production flowline 315 is preferably a rigid steel pipe-in-pipe insulated flowline such as a catenary riser. It is also preferred that the various jumpers and trees used in the subsea production cluster 310 be insulated. The insulation is designed such that the produced fluids do not enter hydrate formation conditions during steady state conditions at the anticipated minimum flow rates for the produced fluids. However, the water injection flowline 325 is preferably a rigid steel uninsulated flowline.

For the production riser 335*p*, the connection to the production facility 330 may include a length of flexible production hose 332. Similarly, for the injection line 335*i*, the connection to the production facility 330 may include a length of flexible injection hose 334. This is particularly true if a riser tower (not shown) is used. It is understood that the connection between the production riser 335*p* and the flexible production hose 332 is typically at or near a buoy 336. Similarly, it is understood that the connection between the production riser 335*p* and the flexible production hose 332 is typically at or near a separate buoy 338.

Next, the production system 300 preferably includes a "crossover manifold" 340. The crossover manifold 340 defines an arrangement of pipes and valves that provide selective fluid communication between the production manifold in the production cluster 310 and the injection manifold in the injection cluster 320. The crossover manifold 340 provides a connection path between the water injection flowline 325 and the production flowline 315 for the purpose of moving a pig from the injection cluster 320 to the production cluster 310. The pig is shown at 345 in FIG. 4. Greater details concerning features of the crossover manifold 340, the injection cluster 320, the production cluster 310, and the pig 345 are discussed in connection with FIG. 4, below.

In the view of FIG. 3, the crossover manifold 340 is indicated as a component separate from the production cluster 310 and the injection cluster 320. However, it is understood that the crossover manifold 340 may share certain valves and lines with the production cluster 310 and the injection cluster 320.

The subsea production system 300 also may include an umbilical 355. The umbilical 355 may comprise one or more chemical injection tubings, one or more electrical power lines, one or more electrical communication lines, one or more hydraulic fluid lines, a fiber optics communication line, and an oil injection tubing. The chemical injection tubing within the umbilical 355 transmits a hydrate inhibitor to the ocean floor, and then to production equipment of the subsea processing system 300. Similarly, the oil injection tubing transmits a displacement fluid such as diesel or dead crude to the ocean floor. Thus, the umbilical 355 contains a number of lines bundled together to provide electrical power, control, hydraulic power, chemical transportation, or other functionalities.

An umbilical termination assembly 350 is provided in the system 300. The umbilical termination assembly ("UTA") 350 is preferably landed on the ocean bottom proximate the crossover manifold 340. The umbilical 355 is connected at an upper end to the host production facility 330, and at a lower end to the UTA 350.

Various other features may optionally be included in the subsea production system 300. For example, the production flowline 315 may include a gas lift injection system. An example of a gas lift injection point is shown at 360. Gas is injected at the base of the production riser 335*p* to help carry fluids to the production facility 330, if necessary.

Figure 4:
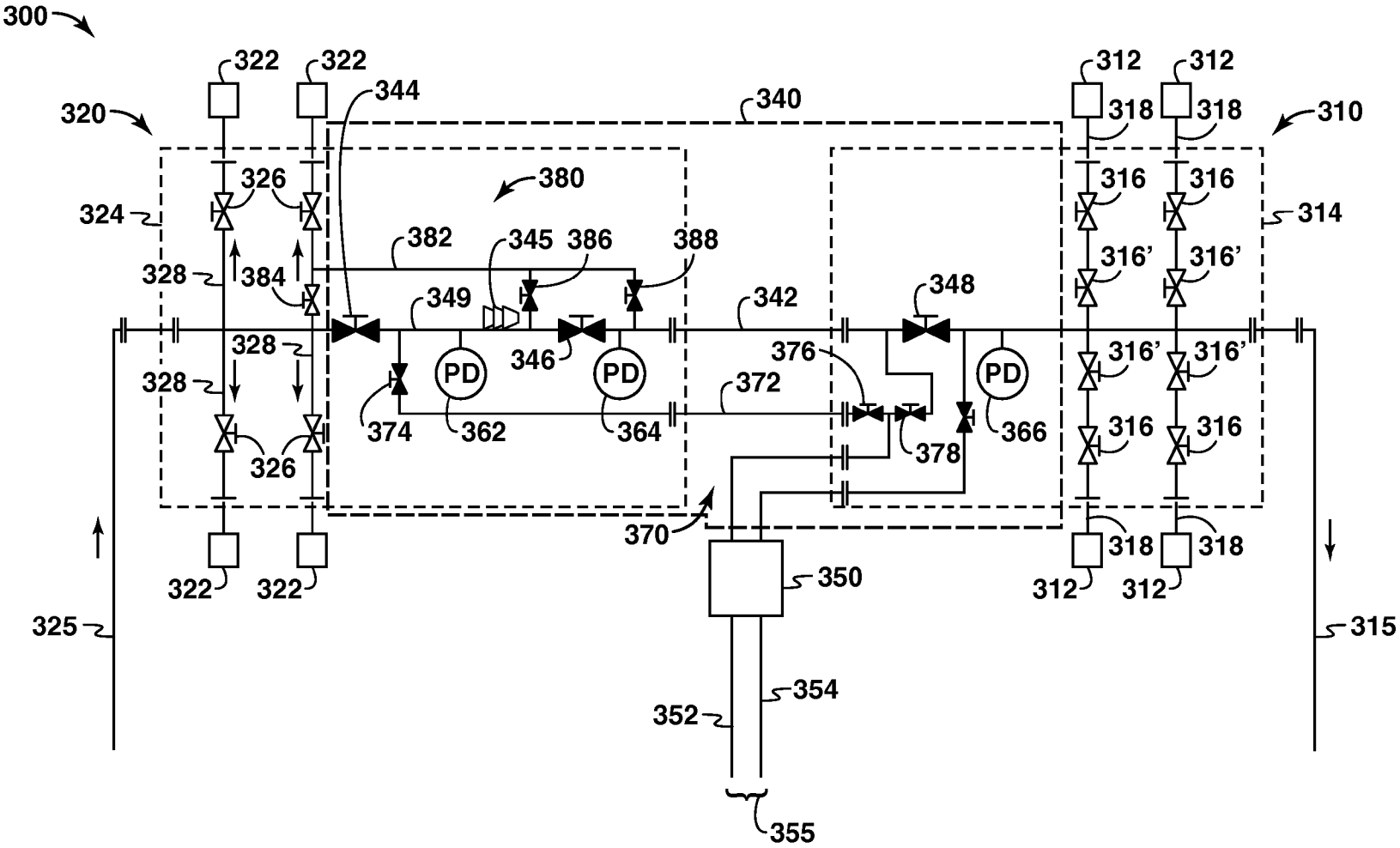
FIG. 4 is a plan view of the production system of FIG. 3. In this view, production fluids are being transported away from the production system through a single production line, water is being transported to the water injection system and the utility umbilical is transporting control fluid, chemicals and displacement fluids to the crossover manifold in the production and water injection systems.

FIG. 4 is a plan view of a portion of the production system 300 of FIG. 3. In this view, the subsea production system 300 is "on-line." Production fluids are being transported through the production flowline 315 and to the host production facility 330 (not seen in FIG. 4). It is noted that a single production flowline 315 is employed in the subsea production system 300.

Additional details of the subsea production system 300 are seen in FIG. 4. Specifically, greater details concerning the production cluster 310, the injection cluster 320, and the crossover manifold 340 are seen. First, the production cluster 310 includes a plurality of producers 312. In the illustrative arrangement 300, four separate producers 312 are seen. However, any number of production wells may be utilized in the method 200 of the present invention.

The producers 312 are in fluid communication with a production manifold 314. The production manifold 314 comprises a body having a number of valves 316 for controlling the flow of fluid therethrough. Jumpers 318 provide fluid communication between the producers 312 and the valves 316 of the production manifold 314. Optionally, and as shown in FIG. 4, two sets of valves 316 are provided in-line with each jumper 318: (1) valves 316 adjacent the producers 312, and (2) intermediate valves 316' adjacent the manifold 314. This allows the jumpers 318 to be inhibited without completely opening them to the flow of production fluids.

Next, referring to the injection cluster 320, the injection cluster 320 first includes one or more injectors 322. In the illustrative arrangement of the production system 300, four separate injectors 322 are provided. However, any number of injectors 322 may be utilized.

The injection cluster 320 includes a water injection manifold 324. The water injection manifold 324 defines a plurality of valves 326 for providing selective fluid communication with the various injectors 322. Fluid communication is provided through separate jumpers 328.

Of particular interest, a pig 345 is seen within the injection cluster 320. Pigging capability is provided to improve displacement efficiency when displacing the production flowline 315 at the beginning of a long-term shutdown. Preferably, the pig 345 is a batching pig that is fabricated from an elastomeric material that will avoid degradation during storage in a cold, fluid environment. Preferably, the pig 345 will also have the capability of scraping deposited solids from the interior of the production flowline.

The pig 345 is initially transported from the host production facility 330 to a subsea storage location 349 through the water injection line 325/335*i*. The pig 345 remains in the subsea storage location 349 during production. More specifically, the pig 345 remains in the subsea storage location 349 until hydrate management steps 200 begin in connection with a long-term shutdown. As part of the hydrate management steps 200, the pig 345 is "launched" from the subsea storage location 349 in order to displace live hydrocarbon fluids from the production line 315/335*p*. The launching of the pig 345 is described further in connection with a discussion of step 225, below.

Also seen in the production system 300 of FIG. 4 is the crossover manifold 340. In the arrangement 300, the crossover manifold 340 is shown in dashed lines. This is to represent that the crossover manifold 340 is integrally connected with the production manifold 314 and the water injection manifold 324.

The crossover manifold 340 defines a series of valves and pipes. First, a central pipeline 342 is shown. Then, three valves 344, 346 and 348 are seen along central pipeline 342. Valve 344 is a master injection manifold valve; valve 346 is a master crossover manifold injection valve; and valve 348 is a master production manifold valve. As will be described further below, operation of valves 344, 346, 348 controls the movement of fluids and the movement of the pig 345 from the water injection manifold 324 to the production manifold 314.

It can be seen in FIG. 4 that each of the valves 344, 346, 348 is darkened. This indicates that each of the valves 344, 346, 348 is in a closed position. Thus, fluid is prohibited from flowing through the central pipeline 342.

An optional feature in the production system 300 is the use of pig detectors. Several pig detectors are seen in FIG. 4. First, pig detectors 362 and 364 are seen along the water injection manifold 324. Further, pig detector 366 is shown along production manifold 314. The pig detectors 362, 364, 366 provide confirmation to the operator concerning the movement of the pig 345 through the system 300 during a hydrate removal process 200. Pig detectors 362 and 364 specifically provide positive indication of pig 345 arrival and departure in the subsea storage location 349. Pig detector 366 provides confirmation of arrival of the pig 345 in the production manifold 314. The pig detector 366 is positioned at a point beyond the injection point of displacement fluid from the control umbilical 355.

The crossover manifold 340 may be configured in two ways: If the field is developed with both a production manifold 314 and a water injection manifold 324, then the crossover manifold 340 is preferably split, with some components on the production manifold 314, and other components on the water injection manifold 324. The two manifolds 314, 324 are optionally interconnected with a central pipeline 342 and a kicker line 372 for methanol.

As an alternative, the field may be developed with in-line tees (without separate water injection and production manifolds). In this instance, the crossover system 340 consists of a stand-alone manifold located near the outer end of the production flowline 315. The water injection flowline 325 and the crossover manifold 340 are interconnected by an extension of the water injection flowline 315, and a smaller-bore water return line (not shown).

Also visible in FIG. 4 is a UTA 350. The UTA is seen in fluid communication with the control umbilical 355. Two representative lines are seen making up the control umbilical 355. These represent (1) a chemical injection service line 352 (also referred to as chemical injection tubing), and (2) a displacement fluid injection service line 354 (also referred to as oil injection tubing). The chemical injection line 352 primarily serves as a hydrate inhibitor line. Preferably, the displacement fluid injection service line 354 has a minimum inner diameter of three inches in order to accommodate a small pig. The maximum allowable operating pressure of the displacement fluid injection service line 354 should be not less than 5,000 psig for a 3-inch ID service line. The displacement fluid injection service line 354 provides a displacement fluid for displacing live production fluids from the production flowline 315. The displacement fluid injection service line 354 should be piggable for management of wax deposits.

It is understood that the control umbilical 355 will contain a number of other lines comprised of electro-hydraulic steel tube umbilicals. These may include hydraulic power control lines, electrical lines with power/communication conductors, fiber optic lines, methanol injection lines, and other chemical injection lines. The control umbilical 355 connects to the host production facility 330, with the connection configured to include a pig launcher for moving a small pig through line 354. The subsea umbilical termination assembly (UTA) is designed to allow passage of a smaller-diameter pig from the displacement fluid injection service line 354 into the production flowline 315.

The various lines within the control umbilical 355 extend from the FPSO 330 to the ocean bottom. Preferably, the lines (such as lines 352 and 354) are manufactured in a continuous length, including both the dynamic and static sections. The transition from the dynamic to the static section of the control umbilical 355 is as small as possible, and may consist of taper-to-end armor layers, if applicable. The umbilical lines (such as lines 352 and 354) may be installed in I-tubes mounted on the hull of the FPSO 330, and terminating below topside umbilical termination assemblies (TUTA) (not shown). Each umbilical line is preferably provided with a bend stiffener at the "I" tube exit.

FIG. 4 also shows a separate production flowline 315 and water injection flowline 325. The production flowline 315 receives produced fluids from the production manifold 314. The water injection flowline 325 delivers water to the water injection manifold 324.

In the operational stage shown in FIG. 4 and represented in step 205, the subsea production system 300 is in production. Water is being delivered from the production facility 330, through the water injection riser 335*i*, through the water injection flowline 325, and down to the water injection manifold 324. Valves 326 are open, permitting injected water to flow to the various injectors 322. From there, it is understood that the water is injected into one or more formations, either for disposal purposes or for purposes of maintaining reservoir pressure or providing sweep.

During the production stage of FIG. 4, the master water injection manifold valve 344 and the crossover manifold valve 346 are closed. This prevents the pig 345 from moving through the crossover manifold 340. It also forces water to be moved through the water injection jumpers 328 and into the injectors 322.

On the production side, the various producers 312 are also in operation. Production valves 316 and 316' are in an open position, permitting production fluids to flow under pressure from the producers 312, through the production jumpers 318 and to the production flowline 315. Production fluids then travel upward through the production riser 335*p* in the water column (not shown) and to the host production facility 330.

It is noted here that the master production manifold valve 348 is also in its closed position. This prevents production fluids from backing up to the central pipeline 342 within the crossover manifold 340.

The subsea production system 300 also includes a crossover displacement system 370. The crossover displacement system 370 provides a mechanism to direct a displacement fluid behind the pig 345. The displacement fluid moves the pig 345 from the subsea storage location 349 and through the central pipeline 342 connecting the water injection manifold 324 and the production manifold 314. In this instance, the displacement fluid is preferably a hydrate inhibitor.

The crossover displacement system 370 first comprises a crossover displacement flowline 372. The crossover displacement flowline 372 also connects the water injection manifold 324 and the production manifold 314. The crossover displacement flowline 372 serves as a conduit for sending hydrate inhibitor from the chemical injection line 352 to a point in the subsea storage location 349 behind the pig 345.

The crossover displacement system 370 also comprises a series of valves. These represent a first valve 374, a second valve 376, and a third valve 378. As will be further described below, these valves 374, 376, 378 facilitate the circulation of the displacing fluid using a hydrate inhibitor pumped through the chemical injection line 352. In the operational production stage of FIG. 4, each of valves 374, 376, 378 is darkened, indicating a closed position.

As noted above, the subsea production system 300 also comprises a subsea storage location 349. The subsea storage location 349 defines a section of pipe located between the master injection manifold valve 344 and the master crossover manifold injection valve 346. The subsea storage location 349 serves as a holding place for the pig 345 during production operations.

In addition, the subsea production system 300 includes a water injection return system 380. The water injection return system 380 is normally closed. However, the water injection return system 380 is opened in connection with the launching of a replacement pig (seen at 345' in FIG. 10). This occurs after hydrate management procedures 200 have been completed and the subsea production system 300 is ready to be put back into production.

The water injection return system comprises a return line 382, a first return valve 384, a second return valve 386, and a third return valve 388. In the operational arrangement of FIG. 4, the first return valve 384 is open, while the second 386 and third 388 return valves are closed. Operation of the water injection return system and the storage of a replacement pig 345' is discussed further below in connection with FIG. 10 and step 250.

Various valves have been identified herein for the subsea production system 300. It is understood that the valves related to the injection cluster 320, the production cluster 310, the crossover manifold system 340, the UTA 350, the crossover displacement system 370, and the water injection return system 380 are remotely controlled. Typically, remote control is provided by means of electrical signals and/or hydraulic fluid.

Referring again to FIG. 2, the method 200 next includes the step of initiating hydrate inhibiting. This step is illustrated in Box 210 of FIG. 2A, and may be referred to as "light touch operations." The purpose of the light touch operations is to inject a hydrate inhibitor into the production manifold 314, valves 316, jumpers 318, and wells 312. This, in turn, prevents hydrate formation once production fluids are no longer flowing through the production cluster 310.

Figure 5:
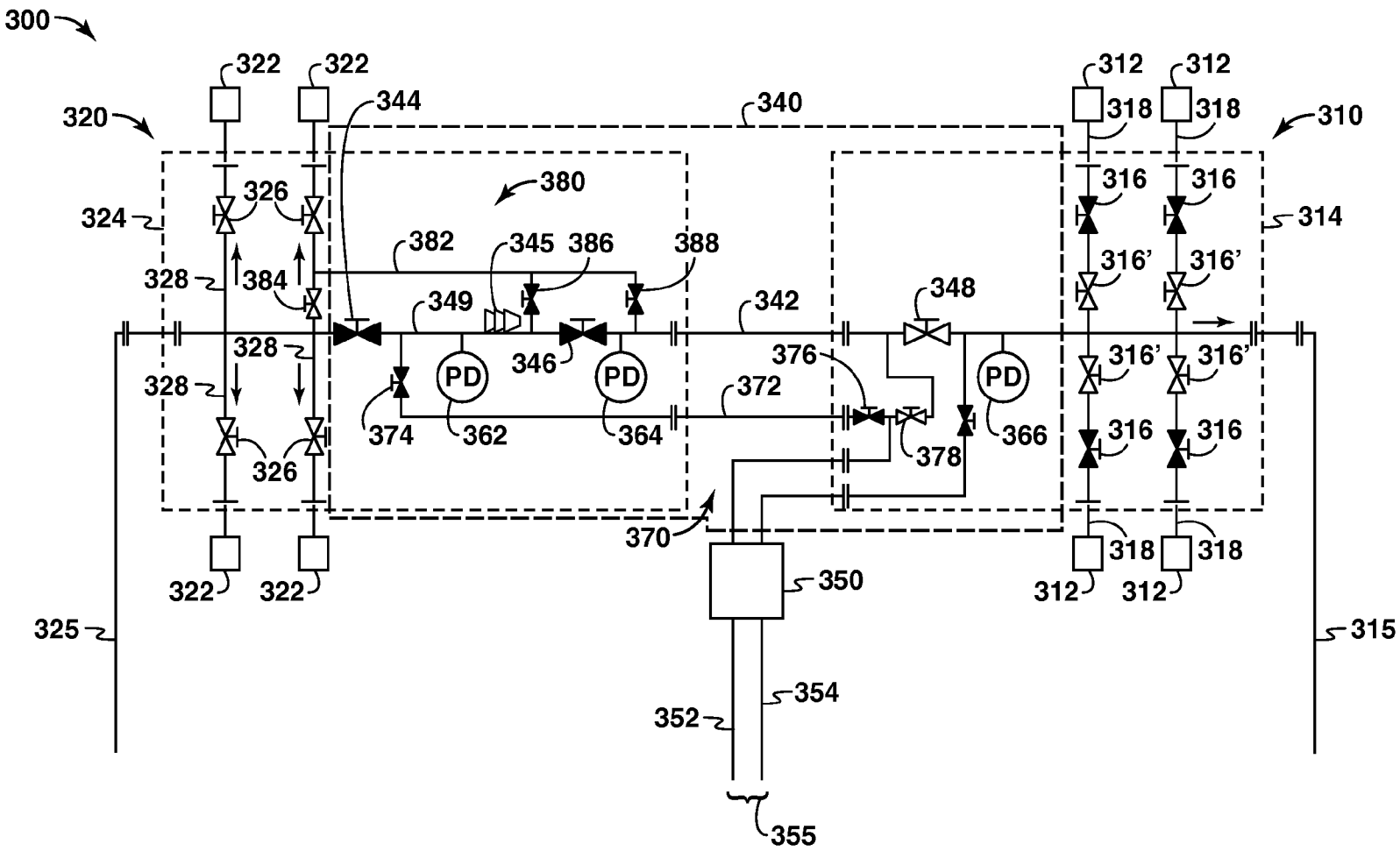

FIG. 5 is another plan view of the production system of FIG. 3. The subsea production system 300 is seen. FIG. 5 demonstrates implementation of step 210. Here, light-touch operations have begun. The injectors may continue to function with the water injection valves 326 remaining open. However, the producers 312 are shut in to production due to system shut-down.

In order to provide the inhibitor, a hydrate inhibiting chemical such as methanol is pumped under pressure from the production facility 330 and through the chemical injection service line 352. Valves 374 and 376 of the crossover displacement system 370 remain closed, while valve 378 is opened. In addition, the master production manifold valve 348 and production valves 316' are opened. Hydrate inhibitor may then be pumped into the production cluster 310 up to valves 316. Production valves 316 and jumpers 318 will be treated by the hydrate inhibitor pump through lines from the production trees and then closed after the operation is complete. Note that while methanol is a preferred hydrate inhibitor, the process may also utilize a low dosage hydrate inhibitor (LDHI) as a hydrate inhibitor. Typically, the LDHI will be admixed with another fluid such as a dead crude (usually not methanol) and may be used instead of methanol or in sequence with methanol. The use of LDHI's in subsea production systems is more fully disclosed in U.S. Provisional Patent Application No. 60/995,134, which is hereby incorporated by reference.

It is noted that for either planned or unplanned shutdowns, the production flowline 315 is depressurized. Depressurization preferably takes place after an established time has elapsed after shut-down. This step is shown in Box 215 of FIG. 2A.

To conduct depressurization, the production valves 316 are closed but the discharge end of the production riser 335*p* remains open. As pressure drops, methane and other gases in the production fluids break out of solution. The gas breaking out of solution may be temporarily flared at the production facility, or stored for later use or commercial sale. For example, recovered gases may be routed to a flare scrubber or to a high pressure flare header (not shown) at the host production facility 330. The removal of gas and depressurization of the production flowline serves to further inhibit the formation of hydrates in the production flowline 315.

Preferably, the subsea production system 300 is designed to allow the system 300 to be depressurized to a pressure below that at which hydrates will form at sea water temperature at the depth of interest on both the upstream and downstream sides of any blockage. Depressurization on the upstream (producer) side of a hydrate blockage may be accomplished via the crossover manifold 340 and the umbilical 355. First, the displacement-fluid service line 354 is emptied by injecting hydrocarbon gas from a high-pressure gas injection manifold on the production facility 330. The hydrocarbon gas forces fluids from the displacement-fluid service line 354 through the crossover manifold 340 and into a production well 312 or a water injection well 322. Pressure is then released, allowing the gas to flow back out of the displacement-fluid service line 354. This depressurization process may be repeated as necessary to completely remove liquids from the fluid displacement service line 354 and to depressurize the production flowline 315 to the lowest achievable pressure.

The method 200 next includes the step of pumping a hydrate inhibitor into the central pipeline 342. The purpose is to purge the central pipeline 342 of water. This step is illustrated in Box 220 of FIG. 2A.

Figure 6:
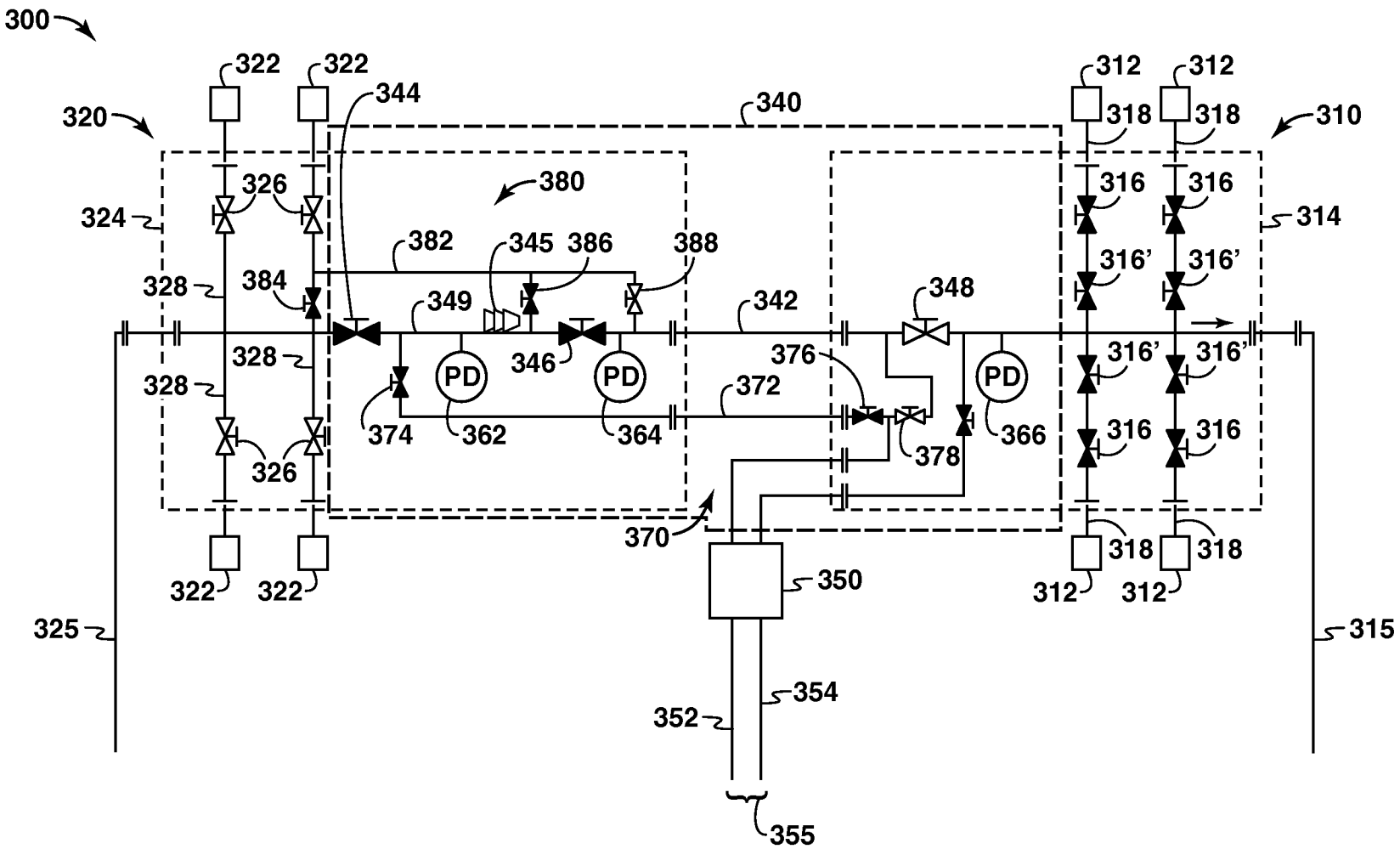
FIG. 6 is another plan view of the production system of FIG. 3. Here, a hydrate inhibitor is being pumped to purge a line connecting a water injection manifold with a production manifold.

FIG. 6 is another plan view of the production system of FIG. 3. The subsea production system 300 is again seen. FIG. 6 demonstrates implementation of step 220. Here, a hydrate inhibitor is being pumped into the central pipeline 342. The water displacement step 220 serves to purge water from the central pipeline 342 connecting the water injection manifold 324 and the production manifold 314.

In performing the water displacement step 220, master production manifold valve 348 is closed and the master water injection valve 344 and the master crossover valves 346 remain closed. In this way, the pig 345 remains secure in the subsea storage location 349. The chemical inhibitor displaces water through the water injection return system 380. The third return valve 388 is opened, causing water and hydrate inhibitor to flow through the return line 382. Displaced water flows into one of the water injection wells 322 via open valve 326.

The method 200 next includes the step of launching the subsea pig 345. This step is illustrated in Box 225 of FIG. 2A. The pig 345 is normally maintained in the subsea storage location 349. The step 225 of launching the pig 345 involves moving the pig 345 from the subsea storage location 349 towards the production manifold 314.

Related to the step 225 of launching the pig 345 is the injection of a displacement fluid. Preferably, the displacement fluid is a hydrate inhibitor such as methanol. This step is illustrated in Box 230 of FIG. 2A. The purpose of step 230 is to urge the pig 345 to move through the flowline 342 connecting the water injection manifold 324 and the production manifold 314. From there, the pig 345 is urged by fluid pressure through the production flowline 315 in accordance with later step 240.

Figure 7:
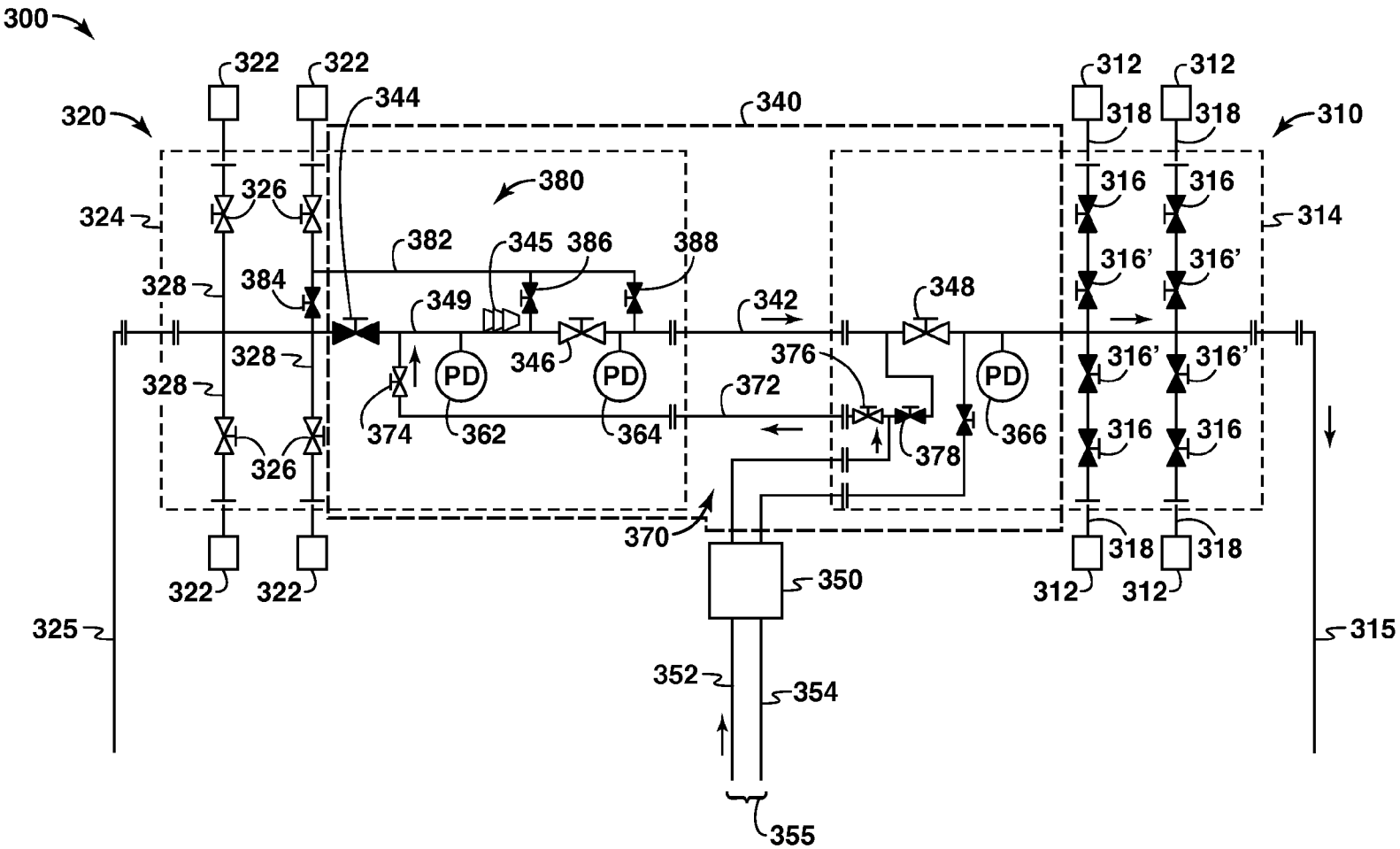
FIG. 7 is another plan view of the production system of FIG. 3. Here, a first pig is being launched from a subsea storage location at or near the water injection manifold. A hydrate inhibitor is pumped into the water injection line behind the pig. This serves to displace live crude from the connecting line and production manifold.

FIG. 7 is another plan view of the production system of FIG. 3. The subsea production system 300 is again seen. FIG. 7 demonstrates implementation of steps 225 and 230. Here, the pig 345 is being launched from the subsea storage location 349. In order to move the pig 345, a hydrate inhibitor is pumped through the chemical injection line 352 of the control umbilical 355. The first 374 and second 376 valves of the crossover displacement system 370 are opened. However, the third valve 378 remains closed. This forces the hydrate inhibitor to move through the subsea storage location 349 behind the pig 345. During this time, the production valves 316 and 316' remain closed in order to shut in the producers 312.

Methanol (or other suitable hydrate inhibitor) can then push the pig 345 through the crossover manifold 340. The methanol acts as a displacement fluid to displace live crude from the flowline 342 and the production manifold 314. In the view of FIG. 7, the pig 345 is at the production manifold 314. However, as will be shown in FIG. 8, the pig 345 will be urged under fluid pressure past the production manifold 314 and up the production flowline 315.

In one aspect, two pigs may be used. The first pig would be pig 345 seen in FIG. 4. This pig 345 would be a production flowline pig. The production facility 330 may have a pig receiver that incorporates a basket that retains a smaller-diameter pig (not seen). The smaller-diameter pig may be used for scraping solids in the service line 354. The smaller pig is launched from the production facility 330 through the service line 354. In either aspect, pigging capability not only displaces live crude, but may also provide for wax and solids management.

The method 200 next includes the step of isolating the pig storage location 349. This step is illustrated in Box 235 of FIG. 2A. Isolating the pig storage location 349 allows displacing fluid to act against the pig 345 as it moves upward through the water column and to the host production facility 330. It also allows a dead crude to be used as the displacing fluid without worrying about the formation of hydrates in the pig storage location 349.

Related to this step 235, the method 200 also includes the step of displacing water and production fluids by pumping a displacement fluid behind the pig 345 (and behind the hydrate inhibitor). This step is illustrated in Box 240 of FIG. 2A. The purpose of step 240 is to urge the pig 345 to move through the production flowline 315 under fluid pressure. This, in turn, serves to displace water and production fluids from the production flowline 315 and to the host production facility 330.

Figure 8:
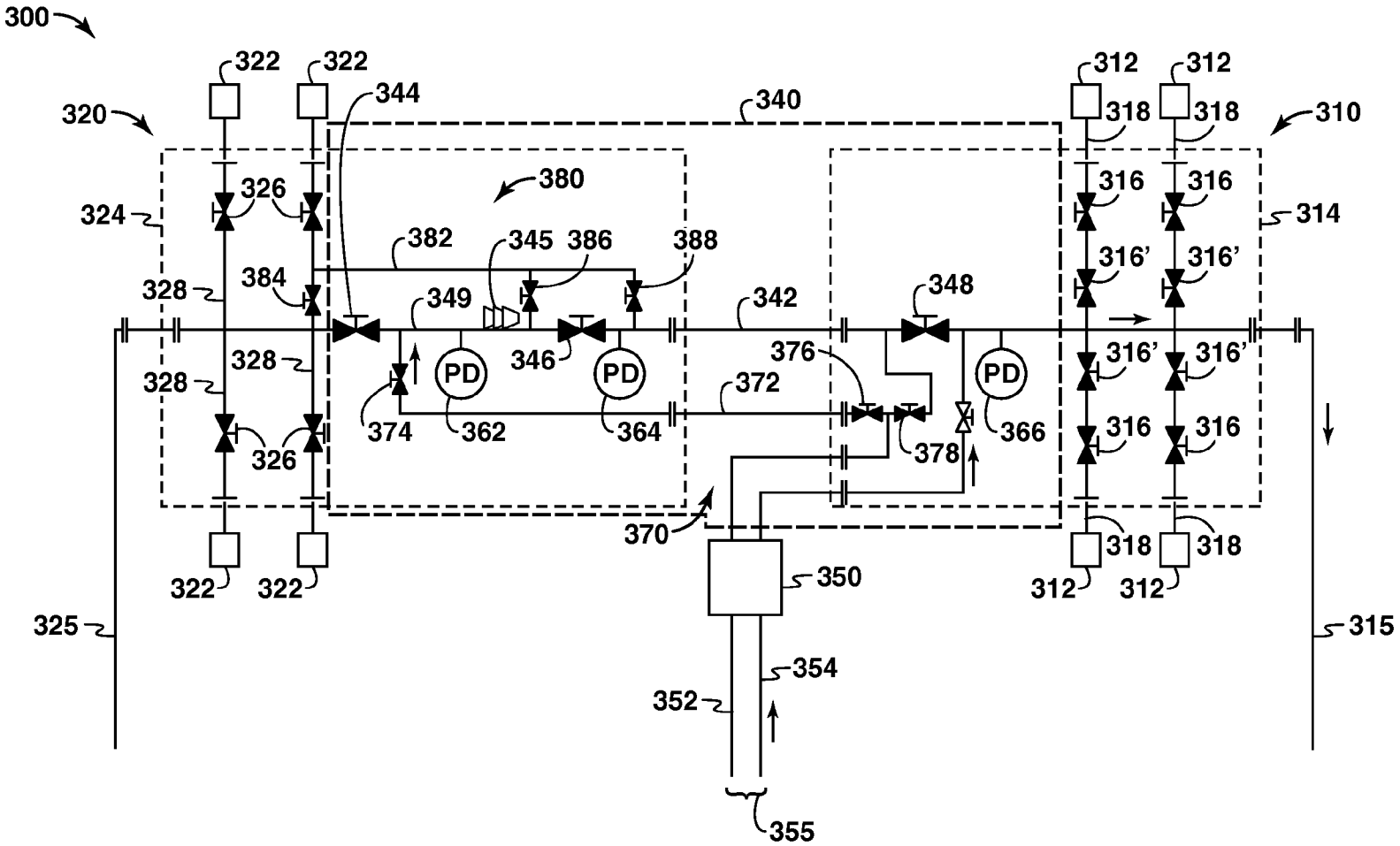
FIG. 8 is another plan view of the production system of FIG. 3. Here, the subsea pig storage location is isolated. The live crude and other production fluids in the production line are displaced by pumping a displacement fluid behind the first pig.

The implementation of steps 235 and 240 are shown together in FIG. 8. FIG. 8 is another plan view of the production system 300 of FIG. 3. The subsea production system 300 is again seen. Here, the subsea pig storage location 349 is re-isolated. This is done by closing the master water injection manifold valve 344 and the crossover manifold valve 346. In addition, the first 374, second 376 and third 378 valves of the crossover displacement system 370 are closed. A displacement fluid is then pumped through service line 354 behind the pig 345. The pig 345 can be seen moving now through the production flowline 315. A fluid control valve 356 is opened to permit the flow of displacement fluid behind the pig 345.

The displacement fluid may be an additional quantity of methanol pumped through displacement fluid service line 354 of the control umbilical 355. However, it is preferred from a cost standpoint that the displacement fluid be dead crude pumped through the displacement-fluid service line 354 of the control umbilical 355. In this instance, the third valve 378 of the crossover displacement system 370 and the master production manifold valve 348 are each closed. In either instance, the pig 345 is pushed to a receiver (not shown) at the host production facility 330 so that all live crude and other production fluids in the riser 315 are pushed ahead of the pig 345.

Displacement is accomplished with dead crude or diesel to prevent hydrate formation. The pig 345, with a methanol slug, is pumped ahead of the dead crude to improve the displacement efficiency and to reduce both chemical requirements and displacement time. The production system 300 is preferably capable of flowing the displacement pig 345 at a velocity of at least 0.3 m/s. Further, the production system 300 is preferably designed to accommodate the operating pressures which occur when driving the pig 345 with dead crude through the displacement line 354.

The method 200 next includes the step of displacing the displacement fluid (the dead crude) from the production system 300. More specifically, the dead crude is displaced from production manifold 314 and the production flowline 315. This step is illustrated in Box 245 of FIG. 2B.

Figure 9:
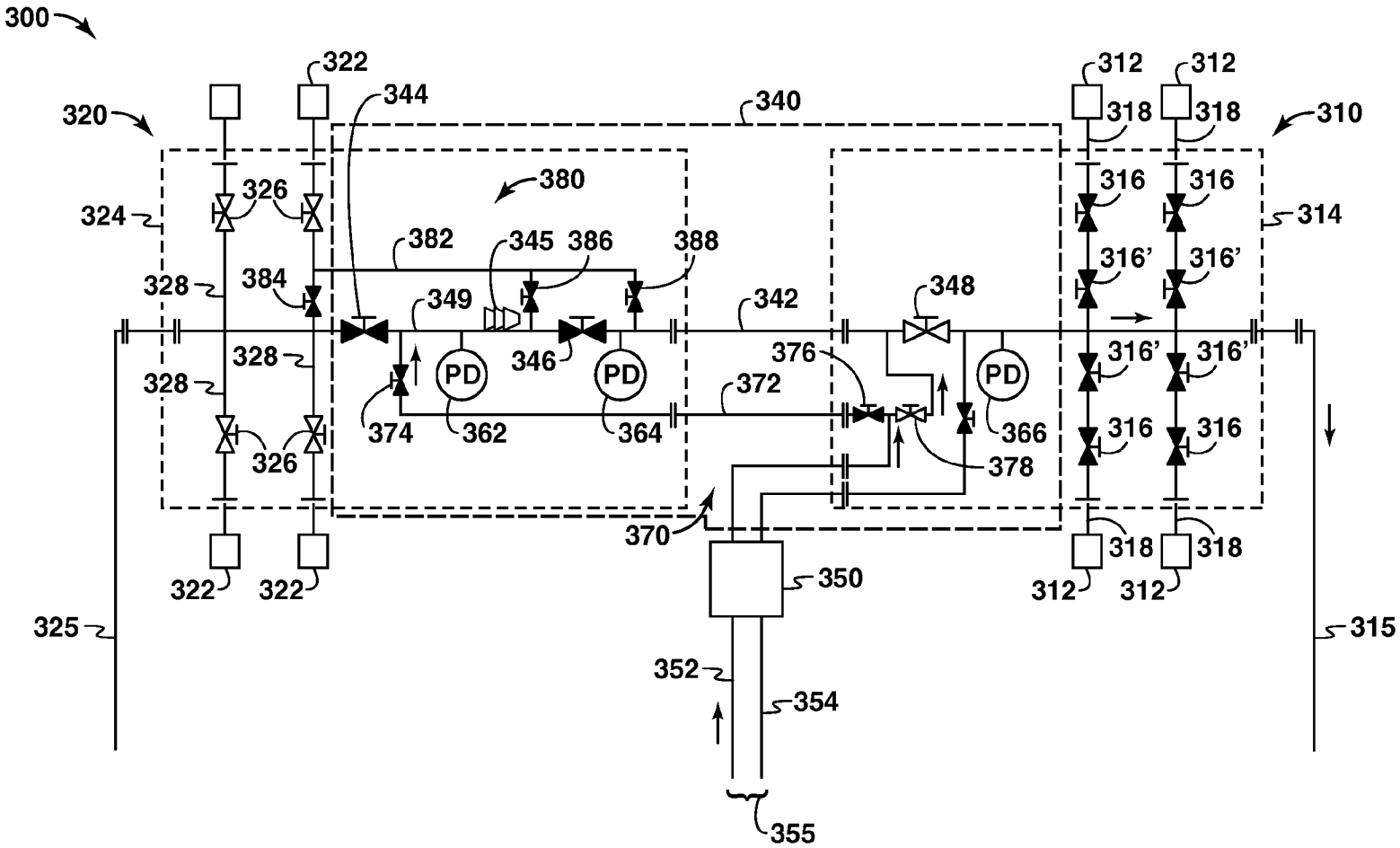
FIG. 9 is another plan view of the production system of FIG. 3. Here, the displacement fluid is displaced from the production manifold using methanol or other hydrate inhibitor. The production system is now ready to be placed back on line.

FIG. 9 is another plan view of the production system of FIG. 3. The subsea production system 300 is again seen. FIG. 9 demonstrates the implementation of step 245 of FIG. 2B. Here, the dead crude is displaced from the production manifold 314 using methanol or other hydrate inhibitor. The hydrate inhibitor is being injected through the methanol line 352.

In order to inject methanol, the first 374 and second 376 valves of the crossover displacement system 370 are closed, but the third valve 378 is opened. Also, the master production manifold valve 348 is opened. Methanol (or other hydrate inhibitor) is urged under pressure through the production manifold 314 and the production flowline 315. Methanol injection will continue during production re-start until the production flowline 315 reaches a minimum safe operating temperature, that is, a temperature that is above the hydrate formation temperature.

In connection with the injection of a displacement fluid, consideration should be given to the tieback distance to the FPSO (or other host facility) 330. The maximum tieback distance for the production system 300 is generally governed by the following parameters:

- the internal diameter of the production flowline 315;
- the internal diameter of the displacement fluid injection service line 354;
- the maximum allowable operating pressure for the displacement fluid injection service line 354;
- the time available for displacement of the production flowline 315;
- properties of the selected displacement fluid (dead crude);
- the depth of the operation; and
- the temperature of the ocean water.

For a given displacement time, the maximum tieback distance is governed by the displacement flow rate that can be developed through the displacement-fluid service line 354 and the production flowline 315. The maximum displacement flow rate, in turn, is governed by the maximum allowable operating pressure ("MAOP") in the integrated umbilical 355. The highest operating pressure in the control umbilical 355 is expected to occur near the touch-down point of the umbilical 355, that is, the point at which the line touches the seabed. The maximum pressure in the displacement-fluid service line 354 during displacement operations should not exceed the line's MAOP. Subject to this requirement, the displacement flow rate should be maximized to reduce the displacement time required, and to achieve an adequate pig 345 velocity during displacement.

Those of ordinary skill in the art of subsea architecture will understand that the smaller the diameter of a flow line, the higher the pressure drop that will be experienced in that line. Similarly, the longer the length of a flow line, the higher the pressure drop that will be experienced in that line.

Preliminary steady-state hydraulics were calculated using PipePhase™ software to determine the maximum tieback distance, as governed by a 12-hour displacement time and maximum allowable operating pressure in a service line (due to friction loss and flow rate). The following table lists the maximum tieback distance for three flow line sizes and three corresponding service line sizes, as follows:

| Production Flowline Nominal Diameter (inches) | Fluid Displacement Service Line (inches) | Maximum Tieback Distance (km) |
|---|---|---|
| 8 | 3.0 | 14.5 |
| 10 | 3.0 | 10.0 |
| 12 | 3.0 | 7.5 |
| 8 | 3.5 | 16.0 |
| 10 | 3.5 | 12.2 |
| 12 | 3.5 | 9.0 |
| 8 | 4.0 | 18.0 |
| 10 | 4.0 | 13.0 |
| 12 | 4.0 | 10.0 |

It can be seen that a larger service line diameter accommodates a longer tieback distance.

An analysis was also conducted as to the maximum displacement or pumping rate that might be used to displace fluids from a production line 315/335*p*/332. The study assumed that production operations were taking place in 1,500 meters of water depth, and that hydrocarbon fluids were being displaced with a 30° API dead crude (45 cp at 40° F.). The arrival pressure of the displacement fluid at the FPSO was assumed to be 350 psig.

For a 3-inch displacement-fluid service line 354 at a 6 km tieback distance, the maximum pumping rate is about 9,000 bbl/day.

In a 3-inch displacement-fluid service line 354 at an 8 km tieback distance, the maximum pumping rate is about 8,000 bbl/day.

In a 3-inch displacement-fluid service line 354 at a 10 km tieback distance, the maximum pumping rate was about 7,000 bbl/day.

In a 3-inch displacement-fluid service line 354 at a 12 km tieback distance, the maximum pumping rate was about 6,500 bbl/day.

In a 3-inch displacement-fluid service line 354 at a 14 km tieback distance, the maximum pumping rate was about 6,000 bbl/day.

In a 3-inch displacement-fluid service line 354 at a 16 km tieback distance, the maximum pumping rate was about 5,500 bbl/day.

For a 4-inch displacement-fluid service line 354 at a 6 km tieback distance, the maximum pumping rate was about 13,500 bbl/day.

In a 4-inch displacement-fluid service line 354 at an 8 km tieback distance, the maximum pumping rate was about 12,000 bbl/day.

In a 4-inch displacement-fluid service line 354 at a 10 km tieback distance, the maximum pumping rate was about 10,100 bbl/day.

In a 4-inch displacement-fluid service line 354 at a 12 km tieback distance, the maximum pumping rate was about 9,000 bbl/day.

In a 4-inch displacement-fluid service line 354 at a 14 km tieback distance, the maximum pumping rate was about 8,000 bbl/day.

In a 4-inch displacement-fluid service line 354 at a 16 km tieback distance, the maximum pumping rate was about 7,500 bbl/day.

It is also noted that the friction loss in the service line and the resulting maximum tieback distance are affected by the viscosity of the displacement crude. The maximum pumping rates described above may be increased by adding a drag-reducing agent to the dead crude. Alternatively, or in addition, the viscosity of the displacement fluid may be lowered.

After the dead crude has been displaced from the production manifold 314, procedures are commenced for placing the production system 300 back on line. Optionally, before the system 300 goes back into production, a new pig 345' may be placed into the subsea storage location 349. Thus, the method 200 may next include the step of launching a replacement pig 345' into the water injection line 325. This step is illustrated in Box 250 of FIG. 2B. However, it is not required to replace the pig before restarting production.

Figure 10:
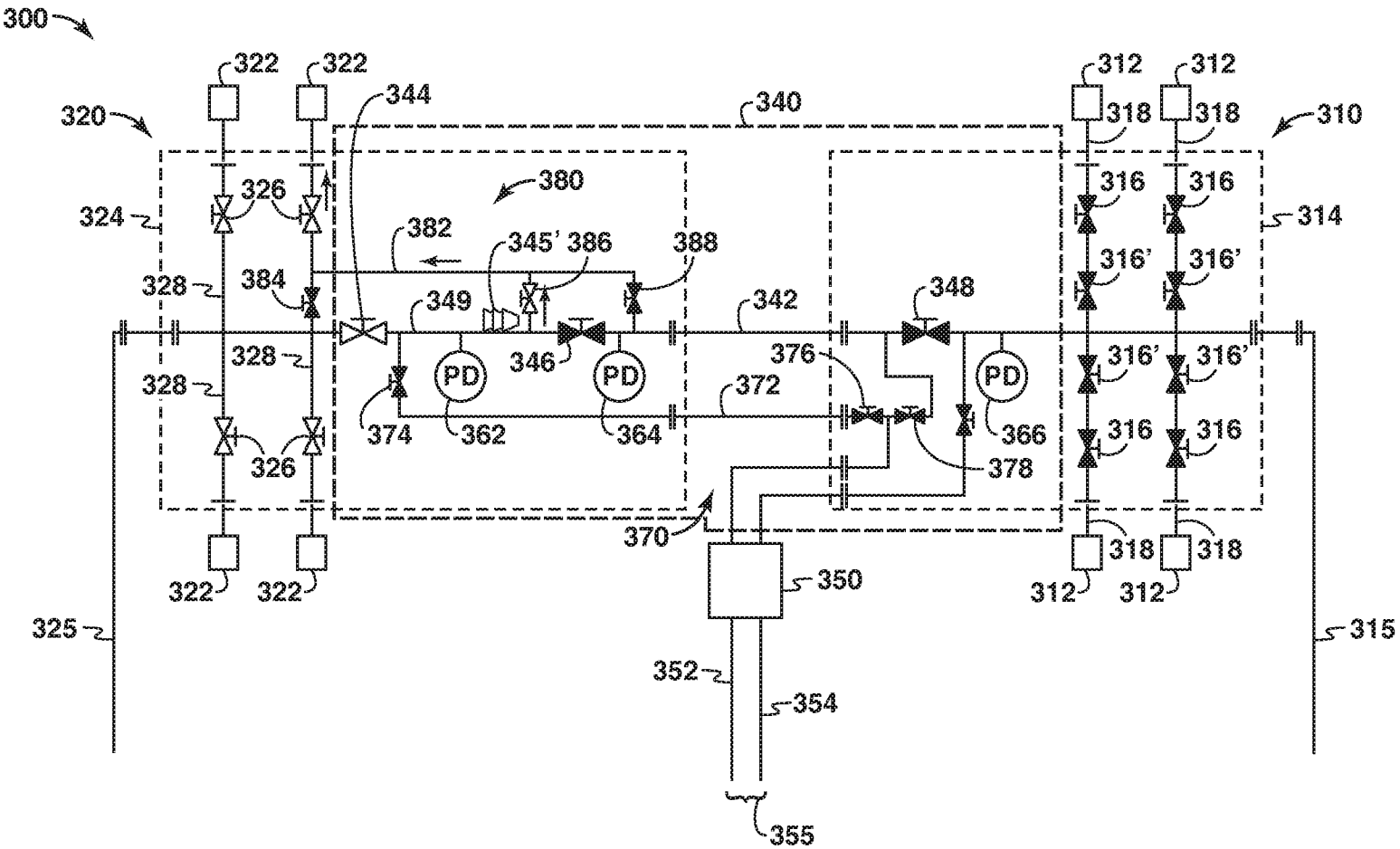
FIG. 10 is another plan view of the production system of FIG. 3. Here, a replacement pig is launched into the water injection line and pushed to the subsea storage location using injection water. A pig detector detects when the pig is parked.

FIG. 10 is another plan view of the production system of FIG. 3. Here, a new pig 345' has been launched into the water injection line 325. Further, the pig 345' has been pushed to the subsea storage location 349 in or near the water injection manifold 324 using injection water. The first pig detector 362 detects when the new pig 345' is parked.

In order to land the new pig 345' in the subsea storage location 349, the master water injection manifold valve 344 is opened. In addition, the water injection valves 326 are opened. However, the first 384 and third 388 water injection return valves are closed.

Once the replacement pig 345' is landed in the subsea storage location 349, the pig 345' is secured. This step of the method 200 is indicated at Box 255 of FIG. 2B. In order to secure the pig 345', both the master water injection manifold valve 344 and the crossover manifold valve 346 are closed. Further, the second 386 water injection return valve is closed. The first valve 384 may be opened.

After the new pig 345' is secured, the subsea production system 300 is ready to be placed back on line. The step of putting the production wells 312 back on line is indicated at Box 260 of FIG. 2B. The step of injecting water into the water injection wells 322 is indicated at Box 265 of FIG. 2B.

It is noted that the method 200 does not require that water injection must be completely shut down. If a topside water injection system is available, water injection may continue through the entire process as it does not directly affect the production line. There would typically be some reduction in water flowrate while delivering the replacement pig 345'.

Figure 11:
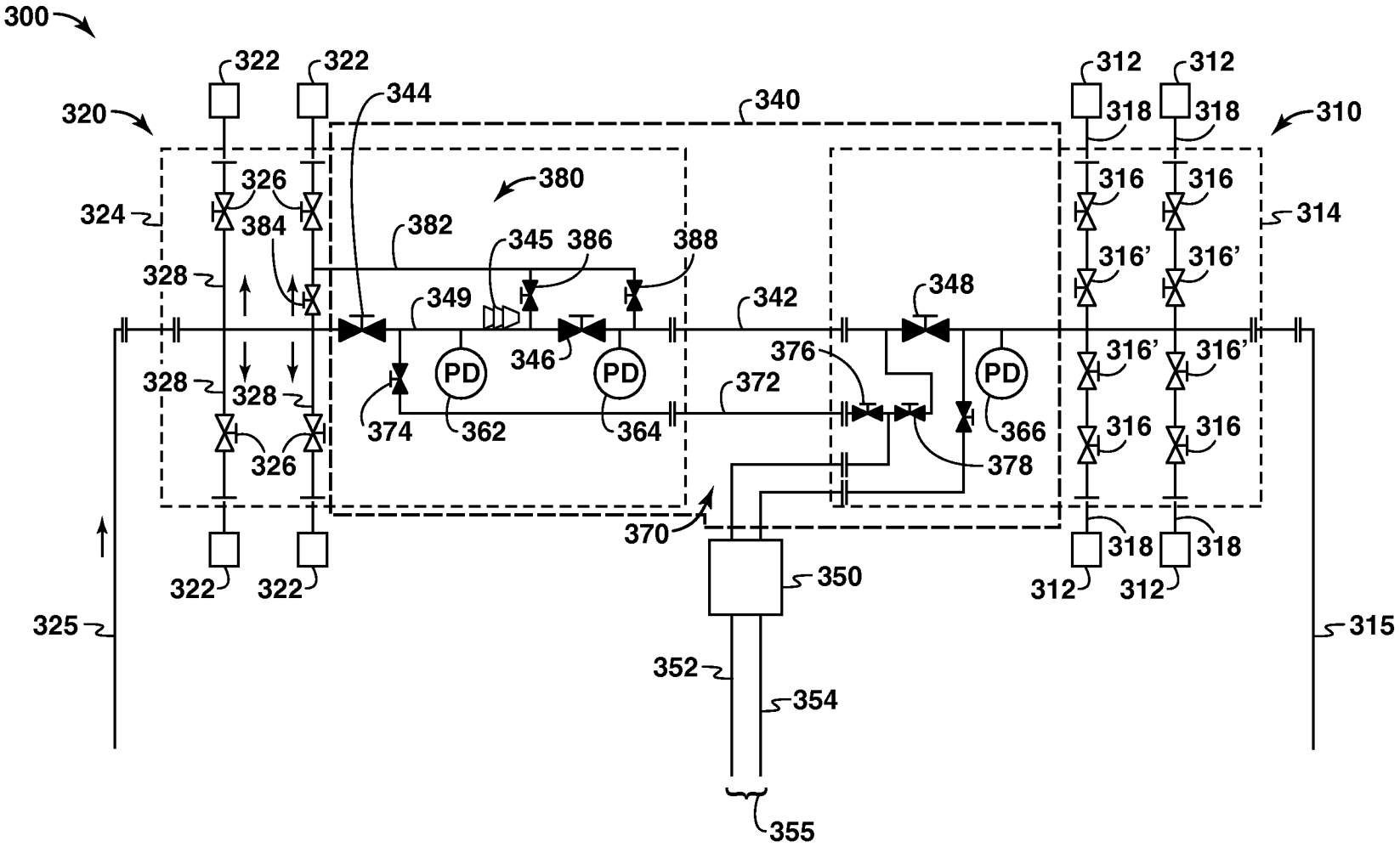
FIG. 11 is another plan view of the production system of FIG. 3. Here, the pig is secured in the subsea storage location. The production wells are placed back on line. A hydrate inhibitor is also preferably mixed with the production fluids until the production line and riser have reached a minimum safe operating temperature.

The steps 255 and 260 are illustrated together in FIG. 11. FIG. 11 is another plan view of the production system 300 of FIG. 3. As can be seen in FIG. 11, water is now being injected through the water injection line 325. Further, water is now flowing through the injection jumpers 328 and to the injection wells 322. The injection valves 326 have been opened to permit the flow of injection water.

It is also noted that the water injection return system 380 has been closed. In this respect, water is no longer flowing through the return line 382. While the first 384 water injection return system valve is open, the second 386 and third 388 water injection return system valves are closed.

It is also seen that the crossover displacement system 370 is also closed to fluid flow. In this respect, the first 374, second 376 and third 378 bypass valves are closed. Preferably, hydrate inhibitor for production well re-start operations will be provided through other inhibitor lines in the umbilical (not shown). In any event, valve 348 should be closed so that produced fluids will not enter central pipeline 342.

It can also be seen in FIG. 11 that the production wells 312 have been placed back on line. The production valves 316 closest to the wells 312 have been opened to permit the outbound flow of production fluids into the jumpers 318. Similarly, the production valves 316' closest to the manifold 314 are now opened for production. In the view of the subsea production system 300 of FIG. 11, it is understood that methanol or other hydrate inhibitor may be injected into the production manifold 314 as the producers 312 are first brought into production.

As production continues, the operator may choose to continue injecting water through the water injector line 325. The purpose may be to simply dispose of water into a subsurface formation. Alternatively, water may be injected in order to maintain reservoir pressure or provide sweep efficiency. Again, the step of continuing to inject water through the water injection line 325 is illustrated at Box 265 of FIG. 2B.

A final step in the method 200 for managing hydrates is to produce production fluids to the host production facility 330. This step is illustrated in Box 270 of FIG. 2B.

Figure 12:
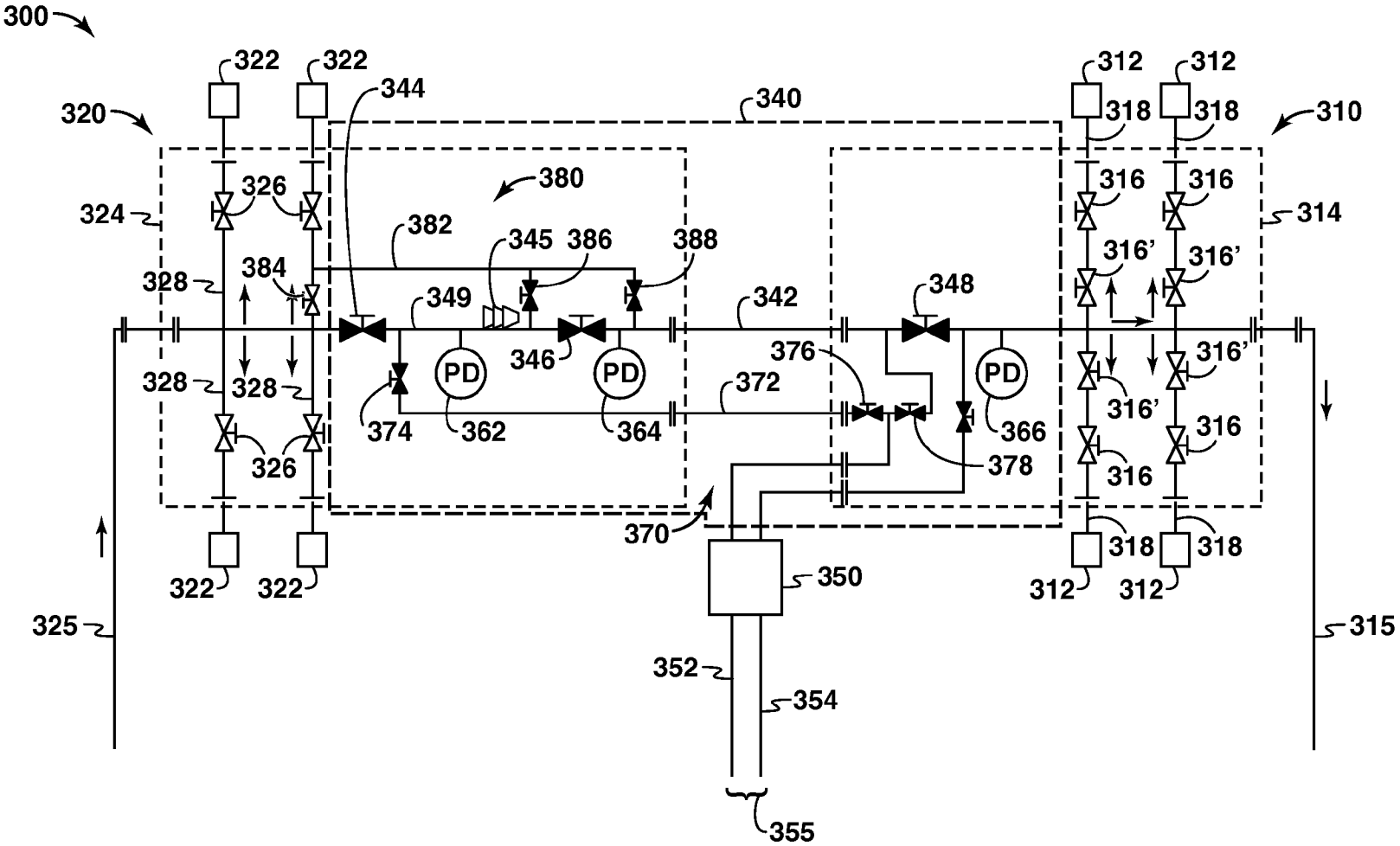
FIG. 12 is another plan view of the production system of FIG. 3. The production wells remain on line, and water injection continues. Production is established.

FIG. 12 is another plan view of the production system of FIG. 3. Here, it can be seen that the production valves 316, 316' have been opened. Production fluids are able to flow through the production jumpers 318, through the production manifold 314, and into the production flowline 315. From there, production fluids flow through the production riser 335*p* and the flexible production hose 332, and to the production facility 330.

A hydrate inhibitor is preferably mixed with the production fluids until the jumpers 318 and production flowline 315 have reached a steady state operating temperature. In one aspect, the subsea production system 300 is designed such that the produced fluids never enter into the hydrate formation region during steady state conditions at the defined minimum flowrates for the wells and flowlines. In one aspect, the time available for the single production flowline displacement is 12 hours, based on a 20-hour cool-down time and 8 hours combined no-touch and initial hydrate inhibitor application.

It is preferred that the time duration for start-up procedures be of sufficiently short duration to minimize any paraffin or "wax" deposition that may take place. Wax deposition is preferably managed by maintaining temperatures throughout the production stream above the wax appearance temperature (WAT).

It is also preferred that the subsea production system 300 be maintained with intermittent pigging. Regular maintenance pigging helps to ensure that the displacement pig 345' will not become lodged during later displacement operations. The displacement pig 345 may be periodically run through the production flowline 315 for the purpose of maintaining flow assurance in the production flowline.

Various other features may be incorporated into the subsea production system 300. For instance, coiled tubing access may be provided from the production facility 330 to remediate hydrates, wax, asphaltenes, scale, sand, and other solids in the production flowline 315. Also, the production flowline 315 may be designed to permit depressurizing and chemical injection from a mobile offshore drilling unit ("MODU") at a connection at the production manifold 314. Further still, a subsea pig launcher may be used in lieu of a crossover manifold.

In addition to the specific steps identified above for the hydrate management method 200, steps may optionally be taken to manage wax buildup in the fluid-displacement service line 354. Wax deposition in the umbilical dead oil service line 354 should be managed to prevent blockage or significant reduction in the service line 354 flow capacity over the life of the field. Wax management steps may be a combination of (1) pigging of the service line 354 to remove wax; (2) use of a wax inhibitor to minimize wax deposition in the service line 354; and (3) use of a chemical solvent to remove wax from the service line 354.

The priority and combination of wax management approaches may be selected based on the wax deposition properties of the specific dead crude blends anticipated during the service life of the susbsea production system 300. The number of anticipated displacement events and the wax deposition rate will dictate the cumulative wax deposition buildup, which in turn will guide the required pigging frequency and the opportunity for using wax inhibitors or solvents in lieu of or in addition to pigging.

As can be seen, an improved subsea production system has been provided. The subsea production system utilizes a single production flowline. In one aspect, the subsea production system is intended to provide a single production flowline requiring a low chemical demand. Minimal use of methanol and chemicals for hydrate management is provided. The subsea production system is preferably used for single-field subsea tiebacks in the general range of 10-15 km, although precise tieback limits are case-specific.

While it will be apparent that the invention herein described is well calculated to achieve the benefits and advantages set forth above, it will be appreciated that the invention is susceptible to modification, variation and change without departing from the spirit thereof.

What is claimed is:

1. A method of managing hydrates in a subsea production system, the subsea production system having a host production facility, a production cluster comprising one or more producers, a water injection cluster comprising one or more water injectors, a water injection line, and a single production line for directing fluids from the one or more producers to the host production facility, the method comprising:

storing a pig in the subsea production system by injecting the pig into the water injection line, and advancing the pig into a subsea storage location in the subsea production system using injection water;

storing the pig in the subsea storage location for a period of time;

shutting in production from the one or more producers;

injecting a hydrate inhibitor into the subsea production system in order to move the pig to the subsea production cluster, thereby at least partially displacing production fluids from the production cluster;

launching the pig from the subsea storage location; and injecting a displacement fluid into the subsea production system in order to displace the hydrate inhibitor and any remaining production fluids into the single production line, and to further move the pig through the production line.

2. The method of claim 1, further comprising:

further injecting displacement fluid into the subsea production system in order to displace the hydrate inhibitor and pig through the single production line and to the host production facility.

3. The method of claim 2, wherein the displacement fluid is crude oil, diesel, or a combination thereof.

4. The method of claim 2, wherein the displacement fluid is additional hydrate inhibitor.

5. The method of claim 4, wherein the hydrate inhibitor is selected from the group consisting of methanol and a low dosage hydrate inhibitor (LDHI).

6. The method of claim 2, wherein the production cluster further comprises a production manifold, and jumpers for providing fluid communication between the production manifold and the one or more producers.

7. The method of claim 2, wherein the single production line comprises a subsea production flowline and a production riser in fluid communication with the host production facility.

8. The method of claim 7, wherein the subsea production system further comprises a control umbilical having a hydrate inhibitor line and a displacement fluid service line, and wherein displacement fluid is injected from the displacement fluid service line into the subsea production system.

9. The method of claim 8, wherein injecting a hydrate inhibitor into the subsea production system further comprises pumping the hydrate inhibitor from the hydrate inhibitor line into the production manifold in order to provide light touch operations before moving the pig through the production cluster.

10. The method of claim 7, wherein:

the subsea production system further comprises a water injection cluster comprising one or more water injectors, and a water injection manifold; and the water injection line comprises a water injection riser and a subsea flowline for receiving injection water from the host production facility.

11. The method of claim 10, further comprising:

isolating the subsea storage location after launching the pig.

12. The method of claim 10, wherein:

the subsea production system further comprises a crossover manifold;

a central pipeline resides in the crossover manifold and provides fluid communication between the water injection cluster and the production cluster; and launching the pig comprises advancing the pig from the subsea storage location, through the central pipeline, and to the production manifold.

13. The method of claim 10, wherein the method further comprises:

launching a new pig from the host production facility, through the water injection riser, through the water injection flowline, and to the subsea storage location;

storing the new pig in the subsea storage location; and putting the producers back into production.

14. The method of claim 13, further comprising:

putting the producers back into production; and producing hydrocarbon fluids from the one or more producers, through the production manifold, through the production flowline, through the production riser, and to the host production facility.

15. The method of claim 14, further comprising:

injecting injection water through the one or more injectors.

16. The method of claim 10, wherein storing a pig in the subsea production system comprises placing the pig into a subsea pig launcher, and the method further comprises:

storing the pig in the subsea pig launcher for a period of time; and launching the pig from the subsea pig launcher.

17. The method of claim 2, wherein water continues to be injected through the one or more injectors while the pig is being moved to the subsea production cluster.

18. The method of claim 7, wherein:

the subsea production system further comprises a standalone manifold located near an outer end of the production flowline; and the water injection line and the manifold are interconnected by an extension of the water injection flowline and a smaller-bore water return line.

19. The method of claim 2, further comprising:

depressuring the single production line after shutting in production from the one or more producers.

20. A method of managing hydrates in a subsea production system, the subsea production system having a host production facility, a production cluster comprising one or more producers, a water injection cluster comprising one or more water injectors, a crossover manifold having a central pipeline connecting the production cluster and the water injection cluster, a water injection line, and a single production line for directing fluids from the one or more producers to the host production facility, the method comprising:

storing a pig in a subsea storage location;

shutting in production from the one or more producers;

injecting a hydrate inhibitor into a production manifold of the production cluster to inhibit the formation of hydrates;

further injecting the hydrate inhibitor in order to move the pig from the subsea storage location, thereby at least partially displacing production fluids from the production cluster;

injecting a displacement fluid into the production system in order to displace the hydrate inhibitor and any remaining production fluids into the single production line, and to further move the pig through the production line; and further injecting the displacement fluid into the production system in order to displace the hydrate inhibitor and pig through the single production line and to the host production facility.

21. The method of claim 20, wherein:

the subsea storage location is a water injection manifold in the water injection cluster; and the displacement fluid is a dead displacement fluid.

22. A system for managing hydrates in a subsea production system, the subsea production system comprising:

a production cluster comprising one or more producers operatively connected to a single production line;

a water injection cluster comprising one or more water injectors operatively connected to a water injection line, which is configured to deliver a pig into a subsea storage location, wherein the subsea storage location is operatively connected to at least the water injection line, the single production line, and a chemical injection service line;

a crossover manifold operatively connected to the production cluster, the water injection cluster, and the chemical injection service line configured to inject a hydrate inhibitor into the crossover manifold to move the pig through the production cluster and into the single production line;

a displacement fluid injection service line configured to inject displacement fluid into the crossover manifold; and a control umbilical, the control umbilical comprises at least the displacement fluid injection service line and the chemical injection service line, wherein the production cluster further comprises a production manifold operatively connected to the single production line and at least one production jumper line, each of the at least one production jumper line operatively connected to one of the producers, wherein the water injection cluster further comprises a water injection manifold operatively connected to the water injection line and at least one injection jumper, each of the at least one injection jumper operatively connected to one of the injectors, wherein the crossover manifold further comprise a central pipeline operatively connected to at least the water injection manifold, the production manifold, the chemical injection service line, and the displacement fluid injection service line, wherein the central pipeline is further configured to store the pig and launch the pig.

23. The system of claim 22, further comprising at least one host production facility operatively connected to the water injection cluster by the water injection line and the production cluster by the single production line.

24. The system of claim 22, further comprising at least two host production facilities, wherein the water injection line is operatively connected to one of the at least two host production facilities and the single production line is connected to another of the at least two host production facilities.

* * * * *